US010186197B2

(12) United States Patent
Akimoto

(10) Patent No.: US 10,186,197 B2
(45) Date of Patent: Jan. 22, 2019

(54) DISPLAY DEVICE AND DRIVING METHOD THEREOF

(71) Applicant: Japan Display Inc., Minato-ku (JP)

(72) Inventor: Hajime Akimoto, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 15/478,620

(22) Filed: Apr. 4, 2017

(65) Prior Publication Data

US 2017/0287396 A1 Oct. 5, 2017

(30) Foreign Application Priority Data

Apr. 5, 2016 (JP) ..... 2016-076059

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0426* (2013.01); *G09G 2310/0289* (2013.01); *G09G 2310/08* (2013.01)

(58) Field of Classification Search
None
See application file for complete search history.

(56) References Cited

U.S. PATENT DOCUMENTS 8,619,007 B2 * 12/2013 Park ..... G09G 3/3241 345/76
2005/0017934 A1 1/2005 Chung et al.
2005/0083270 A1 * 4/2005 Miyazawa ..... G09G 3/3233 345/76
2008/0036706 A1 * 2/2008 Kitazawa ..... G09G 3/3233 345/76
2009/0262102 A1 * 10/2009 Tanikame ..... G09G 3/3233 345/212
2011/0254827 A1 * 10/2011 Tamura ..... G09G 3/3648 345/212

FOREIGN PATENT DOCUMENTS

JP 2005-31630 2/2005

* cited by examiner

*Primary Examiner* — Duane N Taylor, Jr.
(74) *Attorney, Agent, or Firm* — Oblon, McClelland, Maier & Neustadt, L.L.P.

(57) ABSTRACT

In the first signal writing period which is a portion of one horizontal scan period, a first pixel signal is input to the first signal line. The first pixel signal is input from the first signal line to a first pixel circuit throughout a first signal converging period which is longer than the first signal writing period. A second pixel signal is input to the second signal line in a second signal writing period which is another portion of the one horizontal scan period. The second pixel signal is input from the second signal line to a second pixel circuit throughout a second signal converging period which is longer than the second signal writing period. After the first signal converging period and the second signal converging period, electric currents are supplied to the light emitting elements of the first pixel circuit and of the second pixel circuit.

11 Claims, 21 Drawing Sheets

DISPLAY DEVICE AND DRIVING METHOD THEREOF

CROSS-REFERENCE TO RELATED APPLICATION

The present application claims priority from Japanese application JP2016-076059 filed on Apr. 5, 2016, the content of which is hereby incorporated by reference into this application.

BACKGROUND OF THE INVENTION

1. Field of the Invention

The present invention relates to a display device and a driving method thereof.

2. Description of the Related Art

Organic electroluminescence (EL) displays include, in each pixel, a drive transistor that controls electric current to be supplied to a light emitting element. Differences, among pixels, in threshold voltage Vth of the drive transistor cause inequality in the electric current among pixels to result in uneven brightness in a displayed image. With regard to this problem, some organic EL displays have a countermeasure that compensates the differences, among pixels, in the threshold voltage Vth of the drive transistor. For example, a display device in Japanese Unexamined Patent Application Publication No. 2005-031630 has a switching transistor disposed between the gate and the drain of the drive transistor. When the drive transistor is in diode-connection by using the switching transistor, that is, when the gate and the drain of the drive transistor are connected with each other through the switching transistor, a pixel signal voltage Vsig is input into the source of the drive transistor (hereinafter, this process is referred to as "signal writing"). As a result of the signal writing, because the drive transistor is in the diode connection, a voltage shifted from the pixel signal voltage Vsig by the threshold voltage Vth of the drive transistor is applied to the gate of the drive transistor. That is, as a result of the signal writing, "Vsig−Vth" is applied to the gate of the drive transistor. Thus, the electric current supplied to the light emitting element does not depend on the threshold voltage Vth of the drive transistor.

In the period of the signal writing, the closer to "Vsig−Vth" the potential of the gate of the drive transistor becomes, the closer to the off-state the drive transistor becomes and the slower the change in the potential of the gate of the drive transistor becomes. Therefore, it takes a long time for the potential of the gate of the drive transistor to reach "Vsig−Vth". In conventional organic EL displays, the signal writing process is conducted throughout one horizontal scan period for securing a sufficient period for the signal writing.

SUMMARY OF THE INVENTION

Organic EL displays include a drive IC (Integrated Circuit) for applying pixel signal voltage Vsig to signal lines formed in the display region. The drive IC includes output terminals connected to the signal lines in a one to one correspondence. Accordingly, the number of the output terminals of the drive IC is the same as that of the signal lines. This, it is necessary for the drive IC to include a large number of output terminals, thereby increasing the manufacturing cost of the drive IC.

With regard to the above problem, it would be effective for reducing the number of the output terminals of the drive IC that each output terminal of the drive IC is connected in turn to a plurality of signal lines. For example, it would be effective that in the first half period of one horizontal scan period, an output terminal of the drive IC is connected to a first signal line to provide a pixel signal voltage to the first signal line and then in the second half period of the one horizontal scan period, the same output terminal is connected to a second signal line to provide a pixel signal voltage to the second signal line. The above process can reduce the number of the output terminals to half. However, the process shortens the period for the signal writing to half of one horizontal scan period, so that the signal writing would end before the voltage of the gate of the drive transistor reach "Vsig−Vth" sufficiently.

An object of the present specification is to provide a display device and a driving method thereof that can reduce the number of the output terminals of the drive IC and secure the period for signal writing process sufficiently.

An embodiment according to the present invention is a driving method for a display device that comprises a plurality of pixels include a first pixel and a second pixel; a first pixel circuit provided to the first pixel, and including a light emitting element and a first drive transistor connected to the light emitting element; a second pixel circuit provided to the second pixel, and including a light emitting element and a second drive transistor connected to the light emitting element; and a plurality of signal lines including a first signal line connected to the first pixel circuit and a second signal line connected to the second pixel circuit. The driving method comprising steps of: inputting a first pixel signal into the first signal line in a first signal writing period that is a partial period in one horizontal scan period to thereby store the first pixel signal in the first signal line; inputting the first pixel signal to the first pixel circuit from the first signal line throughout a first signal converging period that includes at least a portion of the first signal writing period and is longer than the first signal writing period; inputting a second pixel signal into the second signal line in a second signal writing period that is another partial period in the one horizontal scan period to thereby store the second pixel signal in the second signal line; inputting the second pixel signal to the second pixel circuit from the second signal line throughout a second signal converging period that includes at least a portion of the second signal writing period and is longer than the second signal writing period; and turning the first drive transistor and the second drive transistor to an on-state after the first signal converging period and the second signal converging period to thereby supply electric current to the light emitting elements of the first pixel circuit and the second pixel circuit. The above described driving method enables the period ("signal converging period" in the embodiment) for inputting the pixel signal to each pixel to be secured sufficiently and allows the number of the output terminals of the drive IC to be reduced.

An embodiment of a display device according to the present invention comprises: a plurality of pixels including a first pixel and a second pixel; a first pixel circuit provide to the first pixel, the first pixel circuit including a light emitting element, a first drive transistor connected to the light emitting element, and a first circuit for compensating a threshold voltage of the first drive transistor; a second pixel circuit provided to the second pixel, the second pixel circuit including a light emitting element, a second drive transistor connected to the light emitting element, and a second circuit for compensating a threshold voltage of the second drive transistor; a plurality of signal lines including a first signal line connected to the first pixel circuit and a second signal line connected to the second pixel circuit; a drive circuit that supplies pixel signals to the plurality of pixels; and a signal line selection circuit connecting the drive circuit and the plurality of signal lines to each other, the signal line selection circuit being configured to connect the drive circuit and the first signal line in a first signal writing period that is a partial period of one horizontal scan period to allow a first pixel signal to be input into the first signal line from the drive circuit, and the signal line selection circuit being configured to connect the drive circuit and the second signal line in a second signal writing period that is another partial period of the one horizontal scan period to allow a second pixel signal to be input into the second signal line from the drive circuit. The first circuit includes a 1-1 switching element connected to the first signal line, the 1-1 switching element configured to allow the first pixel signal to be input into the first pixel circuit from the first signal line in an on-state of the 1-1 switching element, the 1-1 switching element configured to be in the on-state throughout a first signal converging period that includes at least a portion of the first signal writing period and is longer than the first signal writing period. The second circuit includes a 2-1 switching element connected to the second signal line, the 2-1 switching element configured to allow the second pixel signal to be input into the second pixel circuit from the second signal line in an on-state of the 2-1 switching element, the 2-1 switching element configured to be in the on-state throughout a second signal converging period that includes at least a portion of the second signal writing period and is longer than the second signal writing period. The above described display device enables the period ("signal converging period" in the embodiment) for inputting the pixel signal to each pixel to be secured sufficiently and allows the number of the output terminals of the drive IC to be reduced.

BRIEF DESCRIPTION OF THE DRAWINGS

FIG. 1(*a*) is a side view of the organic EL display, and FIG. 1(*b*) is a plan view of the substrate of the display device.

DETAILED DESCRIPTION OF THE INVENTION

Figure 1:
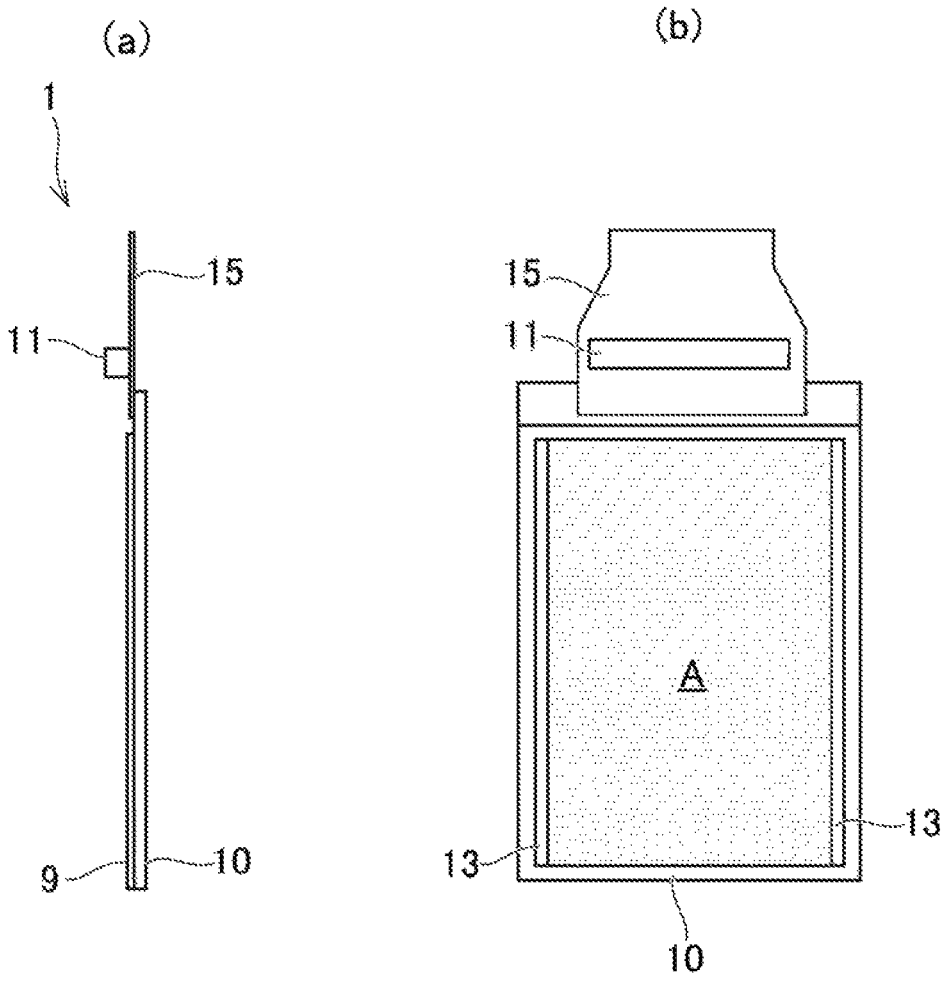
FIG. 1 shows an organic EL display according to an embodiment of the present invention.

Hereinafter, embodiments according to the present invention will be described. The disclosure in the present specification is an example of embodiments according to the present invention. Modification that maintain the gist of the present invention are surely contained in the scope of the invention. In addition, a width, a thickness, and a shape of each portion shown in the drawings are an example of the embodiments. The width, the thickness, and the shape shown in the drawings do not limit the interpretation of the invention. The present specification describes, as an example of the display device according to the present invention, an organic EL display having a light emitting element made of an organic electroluminescence material.

Figure 2:
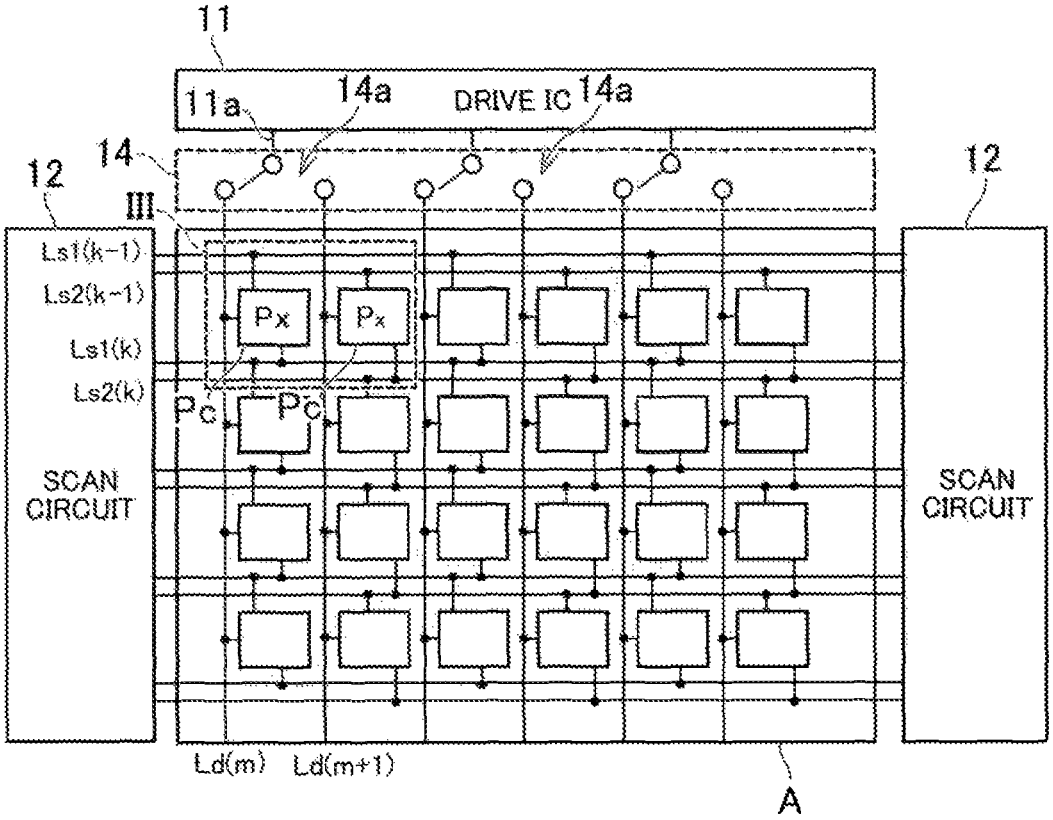
FIG. 2 is for explaining a circuit formed on the substrate of the display device.

FIG. 1 shows an organic EL display device 1 according to an embodiment of the present invention. FIG. 1(*a*) is a side view of the display 1. FIG. 1(*b*) is a plan view of a substrate 10 of the display device 1. FIG. 2 is for explaining a circuit formed on the substrate 10.

As shown in FIG. 1(*a*), the display device 1 has the substrate 10. The substrate 10 has light emitting elements D (see FIG. 3) formed thereon. The display device 1 may include an opposite substrate 9 facing the substrate 10. The display device 1 may include a barrier layer covering the light emitting elements D instead of the opposite substrate 9. The substrate 10 has a display region A (see FIG. 1(*b*)) which displays moving images and/or still images. The display region A has a plurality of pixels Px (see FIG. 2) arrayed thereon in a matrix.

As shown in FIG. 2, the display region A has a plurality of scan lines Ls formed thereon and extending in the horizontal direction. In the example of display device 1, as described in detail later, two scan lines Ls are associated with a single pixel row in which a plurality of pixels are arrayed in the horizontal direction. In FIG. 2, symbols Ls1 and Ls2 are donated to two scan lines, respectively. Further, in FIG. 2, suffixes such as (k−1) and (k) indicating the order of pixel rows are added to the symbols Ls1 and Ls2. Hereinafter, the symbol Ls or the symbols Ls1, Ls2 (not added with the suffixes) are used for the scan line in explanations in which the pixel rows are not distinguished from one another. A scan circuit 12 is formed on the substrate 10. The scan circuit 12 is located outside the display region A and connected to each scan line Ls. Switching transistors, which will be described later, receive a voltage from the scan circuit 12 to become an on-state thereof. The scan circuit 12 applies the voltage to all the scan lines Ls, sequentially. In the example of the display device 1, the scan circuit 12 is formed on both the right side and the left side of the display region A. The scan circuit 12 may be formed only on one of the right side and the left side of the display region A.

The display region A has a plurality of signal lines Ld formed thereon and extending vertically. In FIG. 2, the symbol Ld of the signal line is added with suffixes such as (m) and (m+1) for indicating the order of the pixel columns in which the plurality of pixels are arrayed in the vertical direction. Hereinafter, only the symbol Ld (not added with the suffixes) is used for the signal line in the explanations in which the signal lines are not distinguished from one another. The display device 1 has a drive IC (Integrated Circuit) 11 for inputting a voltage corresponding to a gradation value of each pixel Px to each signal line Ld. (Hereinafter the voltage is referred to as "pixel signal voltage"). In the example of the display device 1, the drive IC 11 is mounted on a Flexible Printed Circuit (FPC) 15. The FPC 15 is connected to the edge of the substrate 10. The drive IC 11 may be directly mounted on the substrate 10. Unlike the drive IC 11, the scan circuit 12 is formed in the substrate 10 together with switching transistors to be described later.

[Signal Line Selection Circuit]

The drive IC 11 includes a plurality of output terminals 11*a*. As shown in FIG. 2, the display device 1 includes a signal line selection circuit 14. The signal line selection circuit 14 is arranged between the signal lines Ld and the drive IC 11 in the circuit. That is, the signal lines Ld are electrically connected to the drive IC 11 via the signal line selection circuit 14. The signal line selection circuit 14 includes a plurality of switches 14*a*. Each switch 14*a* associates a plurality of signal lines Ld with each output terminal 11*a*. In the example of FIG. 2, the switch 14*a* associates each output terminal 11*a* with two signal lines Ld. The switch 14*a* switches the signal lines Ld connected to each output terminal 11*a* during one horizontal scan period. Taking the signal lines Ld(m) and Ld(m+1) as an example, the switch 14*a* connects the signal line Ld(m) and the output terminal 11*a* of the drive IC 11 with each other in a partial period of one horizontal scan period (for example, the first half period of the one horizontal scan period). In the other partial period of the one horizontal scan period (for example, the second half period of the one horizontal scan period), the switch 14*a* connects the signal line Ld(m+1) and the same output terminal 11*a* of the drive IC 11. Signal lines Ld(m+2) and Ld(m+3) (not shown in FIG. 2) are also selectively connected to another output terminal 11*a* of the drive IC 11 via a switch 14*a*. This also applies to signal lines following the signal lines Ld(m+2) and Ld(m+3). The signal line selection circuit 14 inputs the pixel signal voltage received from the drive IC 11 to the signal lines Ld selected by the signal line section circuit 14. The signal line selection circuit 14 enables the number of the output terminals 11*a* of the drive IC 11 to be lower than the number of the signal line Ld, so that the manufacturing cost of the drive IC 11 can be reduced. In this specification, one horizontal scan period means a period obtained by dividing one frame period by the total number of the pixel rows. In other words, one horizontal scan period means a period from the start of light emission of a pixel row to the start of light emission of the immediately next pixel row.

[Pixel Circuit]

Figure 3:
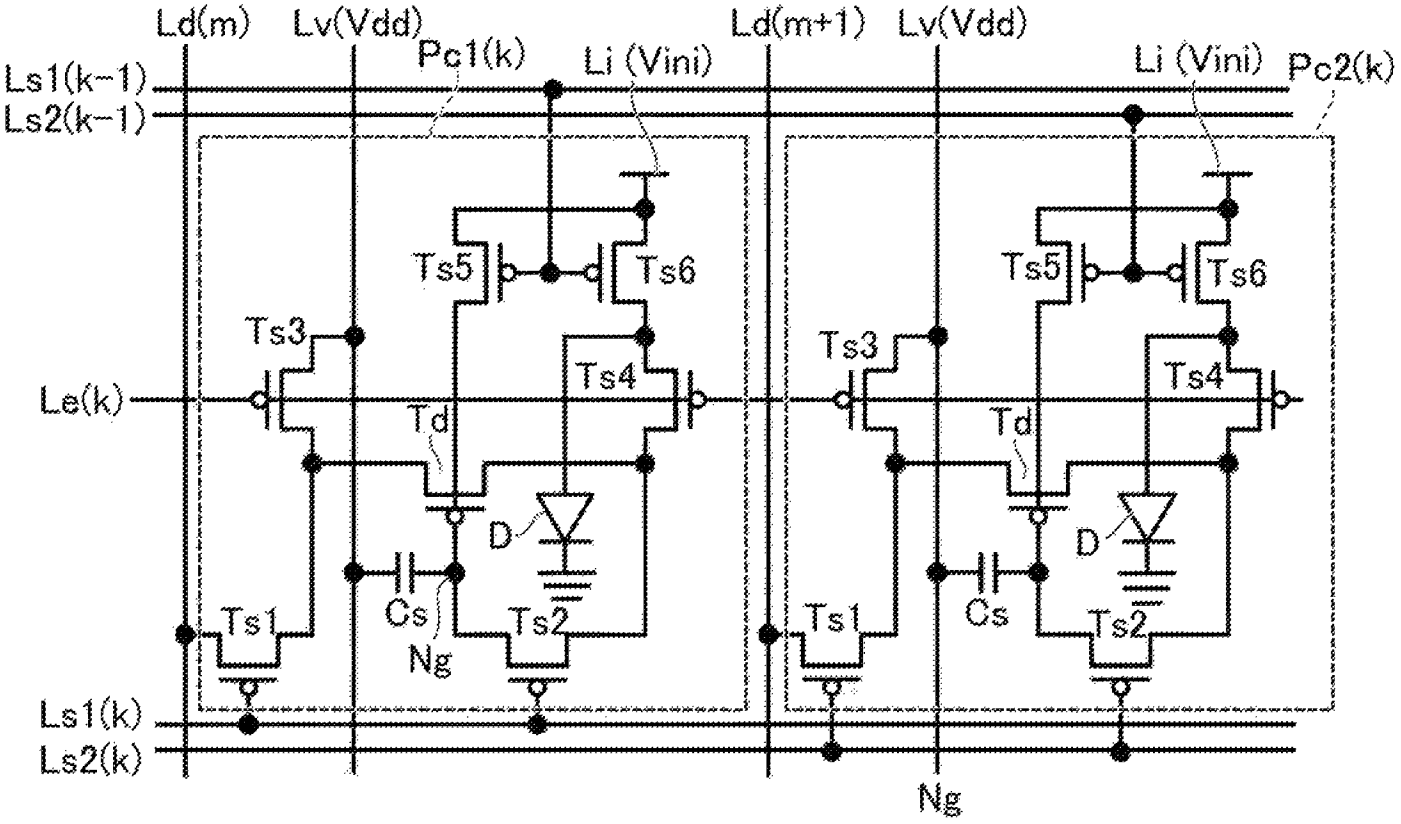
FIG. 3 is a circuit diagram of a pixel circuit provided in each pixel.

As shown in FIG. 2, a pixel circuit Pc is provide for each pixel Px. FIG. 3 is a circuit diagram exemplifying the pixel circuits Pc. This figure shows pixel circuits Pc in the region III of FIG. 2, which are adjacent to each other in k-th pixel row. In the following explanation, the pixel circuit Pc connected to the signal line Ld(m) will be referred to as first pixel circuit Pc1, and the pixel circuit Pc connected to the signal line Ld(m+1) will be referred to as second pixel circuit Pc2. (Since, FIG. 3 exemplifies k-th pixel row, a suffix (k) is added to the symbols Pc1 and Pc2 of the pixel circuit.) Further, in the following explanation, the signal line Ld(m) is referred to as "first signal line", and the signal line Ld(m+1) is referred to as "second signal line". Further, the pixel Px with the first pixel circuit Pc1 is referred to as "first pixel", and the pixel Px with the second pixel circuit Pc2 is referred to as "second pixel". The first pixel circuit Pc1 and the second pixel circuit Pc2 are simply referred to as pixel circuits Pc in explanations common to the two pixel circuits Pc1 and Pc2.

As shown in FIG. 3, each pixel circuit Pc includes a light emitting element D. The light emitting element D emits light with brightness corresponding to the electric circuit supplied to the light emitting element D. In the example of the display device 1, the light emitting element D is an organic light emitting diode including a light emitting layer made of an organic EL material and including an anode an a cathode sandwiching the light emitting layer. In addition, each pixel circuit Pc includes a drive transistor Td. The drive transistor Td is connected to the light emitting element D and controls the electric current supplied to the light emitting element D. The light emitting element D is connected to the power supply line Lv through the source and drain of the drive transistor Td and through the sources and drains of the switching transistors Ts3 and Ts4 to be described later. A power supply voltage Vdd is applied too the power supply line Lv. In the example of display device 1, the light emitting element D is connected to the drain of the drive transistor Td. The signal line Ld is connected to the source of the drive transistor Td through a switching transistor Ts1 to be described later. In the example of display device 1, the drive transistor Td is a PMOS transistor (P-channel Metal Oxide Semiconductor transistor). Alternatively, the drive transistor Td may be a NMOS transistor (N-channel Metal Oxide Semiconductor transistor). When the transistor is a NMOS transistor, the position of the source and drain, and the potential of the power supply are changed from the example of FIG. 3.

Each pixel circuit Pc includes a switching transistor Ts1 that is connected to the signal line Ld and allows input of a pixel signal voltage from the signal line Ld to the pixel circuit Pc. In the example of display device 1, the source of the switching transistor Ts1 is connected to the signal line Ld, and the drain of the switching transistor Ts1 is connected to the source of the drive transistor Td.

As described above, a plurality of scan lines Ls are provided for each pixel row. In more detail, two scan lines Ls1 and Ls2 are provided for each pixel row. FIG. 3 depicts the first scan line Ls1(*k*) and the second scan line Ls2(*k*) provided for the k-th pixel row and depicts the first scan line Ls1(*k*−1) and the second scan line Ls2(*k*−1) provided for the (k−1)th pixel row. The gate of the switching transistor Ts1 of the first pixel circuit Pc1(*k*) is connected to the first scan line Ls1(*k*), and the gate of the switching transistor Ts1 of the second pixel circuit Pc2(*k*) is connected to the second scan line Ls2(*k*). Similarly, to the example of FIG. 3, pixel circuits Pc connected to the signal lines Ld(m) are connected to one line of two scan lines Ls1 and Ls2, and pixel circuits Pc connected to the signal lines Ld(m+1) are connected to the other line.

Each pixel circuit Pc includes a circuit for compensating the threshold voltage Vth of the drive transistor Td. In detail, each pixel circuit Pc includes a switching transistor Ts2 for connecting the drain and the gate of the drive transistor Td with each other. The switching transistor Ts2 connects the drain and the gate of the drive transistor Td when inputting the pixel signal voltage Vsig to the pixel circuit Pc. This operation of the switching transistor Ts2 shifts the voltage stored in the signal storing capacitor Cs from a voltage corresponding to the pixel signal voltage Vsig by the threshold voltage Vth of the drive transistor Td. Accordingly, the electric current supplied to the light emitting element D for emitting light through the drive transistor Td does not depend on the threshold voltage Vth of the drive transistor Td. That is, the threshold voltage Vth of the drive transistor Td is compensated. The operation of the switching transistor Ts2 will be described later in detail.

The gate of the switching transistor Ts2 of the first pixel circuit Pc1(*k*) is connected to the first scan line Ls1(*k*), and the gate of the switching transistor Ts2 of the second pixel circuit Pc2(*k*) is connected to the second scan line Ls2(*k*). The period of the on-state of the switching transistor Ts2 is as long as the period of the on-state of the switching transistor Ts1. In the example of the display device 1, the switching transistors Ts1 and Ts2 are PMOS transistors, but these may be NMOS transistors.

Each pixel circuit Pc includes switching transistors Ts3 and Ts4. The source of the drive transistor Td is connected to the power supply line Lv through the source and drain of the switching transistor Ts3. The drain of the drive transistor Td is connected to the light emitting element D through the source and drain of the switching transistor Ts4. Further, each pixel row has a lightning scan line Le extending in the horizontal direction. The gates of the switching transistors Ts3 and Ts4 are connected to the lightning scan line Le. The gates of the switching transistors Ts3 and Ts4 of the first pixel circuit Pc1(*k*) and the gates of the switching transistors Ts3 and Ts4 of the second pixel circuit Pc2(*k*) are connected to a common lighting scan line Le(k). In the example of display device 1, the switching transistors Ts3 and Ts4 are PMOS transistors, but these may be NMOS transistors.

Each pixel circuit Pc includes a signal storing capacitor Cs. One electrode of the signal storing capacitor Cs is connected to the gate of the drive transistor Td. In the example of display device 1, the other electrode of the signal storing capacitor Cs is connected to the power supply line Lv.

Each pixel row has an initialization voltage line Li. An initialization voltage Vini is applied to the initialization voltage line Li. Each pixel circuit Pc includes switching transistors Ts5 and Ts6. The gate node Ng of the drive transistor Td is connected to the initialization voltage line Li through the source and drain of the switching transistor Ts5. Light emitting element D is connected to the initialization voltage line Li via the source and drain of the switching transistor Ts6. The gates of the switching transistors Ts5 and Ts6 are connected to the scan line of the pixel row immediately previous to the current pixel row. In the example of FIG. 3, the gates of the switching transistors Ts5 and Ts6 provided in the first pixel circuit Pc1 (*k*) are connected to the first scan line Ls1(*k*−1), and the gates of the switching transistors Ts5 and Ts6 provided in the second pixel circuit Pc2(*k*) are connected to the second scan line Ls2(*k*−1). The switching transistors Ts5 and Ts6 in the example of display device 1 are PMOS transistors, but these may be NMOS transistors.

[Pixel Circuit Operation]

Figure 4A:
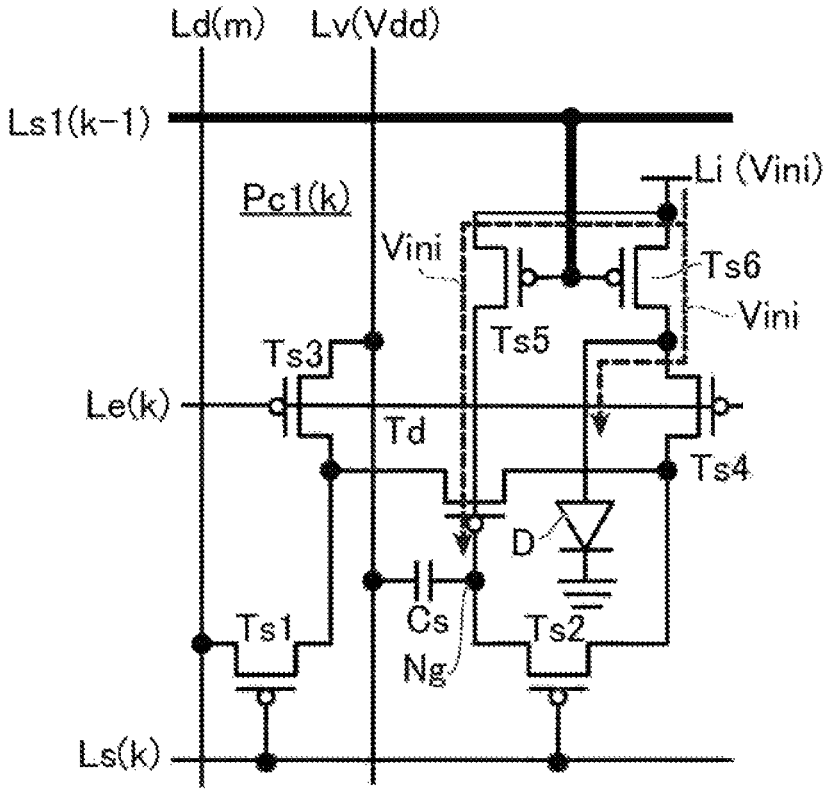
FIG. 4A is for explaining an initialization period.
Figure 4B:
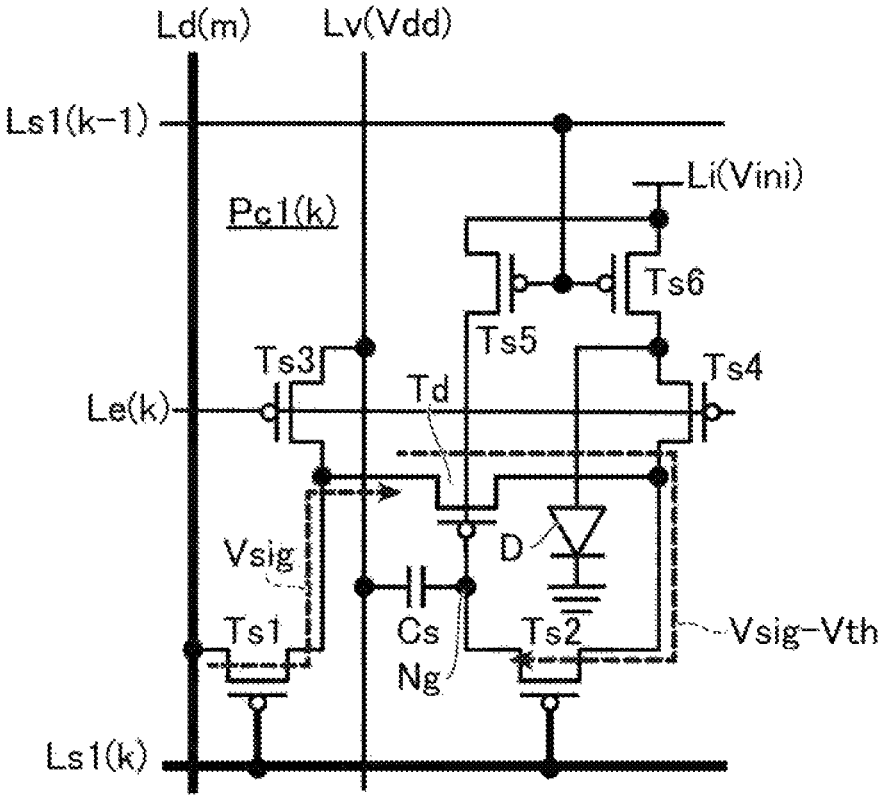
FIG. 4B is for explaining a signal writing period and a signal converging period.
Figure 4C:
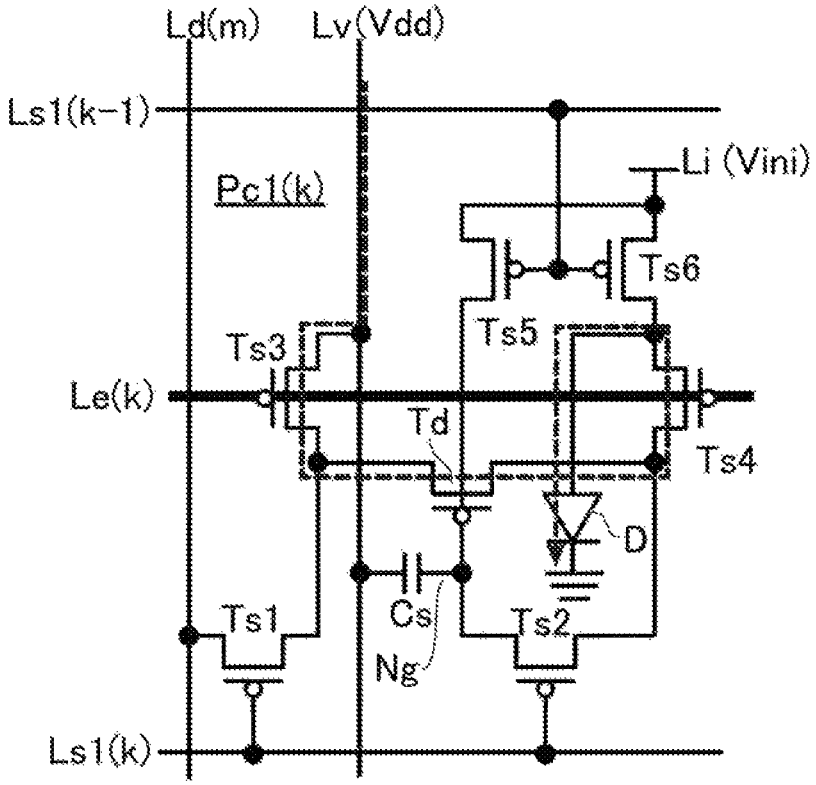
FIG. 4C is for explaining a light emitting period.

FIGS. 4A to 4C are for explaining the operation of each pixel circuit Pc. FIG. 4A is for explaining the operation in the initialization period. FIG. 4B is for explaining the operation in signal writing period and signal converging period to be described later. FIG. 4C is explaining the operation in light emitting period to be described later. In the following description, an operation of the first pixel circuit Pc1(*k*) will be explained as an example. Further, in the following description, a voltage that turns the switching transistors Ts1 to Ts6 to the on-state will be referred to as "on-voltage Von", and a voltage that turns the switching transistors Ts1 to Ts6 to the off-state will be referred to as "off-voltage Voff". As described above, since the switching transistors Ts1 to Ts6 in the example of display device 1 employ PMOS transistors, the off-voltage Voff is a high voltage and the on-voltage Von is a low voltage lower than the high voltage.

As shown in FIG. 4A, in the initialization period, the on-voltage Von is applied to the first scan line Ls(*k*−1), so that the switching transistors Ts5 and Ts6 turns to the on-state. In this period, the off-voltage Voff is applied to the first scan line Ls(k) and the lightning scan line Le(k). As a result, the initialization voltage Vini is applied to the light emitting element D to stop the element D from emitting light. Further, the initialization voltage Vini is applied to the electrode of the signal storing capacitor Cs on the gate side of the drive transistor Td. The other switching transistors Ts1 to Ts4 are in the off-state.

After the initialization period, the pixel signal voltage Vsig is input to the first signal line Ld(m) from the drive IC 11 through the signal line selection circuit 14 to be stored in the first signal line Ld(m). In the following, the period during which the pixel signal voltage Vsig is input to the signal line Ld is referred to as "signal writing period".

Further, after the initialization period, as shown in FIG. 4B, an on-voltage Von is applied to the first scan line Ls(k) to turn the switching transistors Ts1 and Ts2 to the on-state. As a result, the drain and the gate of the drive transistor Td are connected with each other through the switching transistor Ts2. That is, the drive transistor Td turns to be diode connected. In this state, a pixel signal voltage Vsig is supplied from the first signal line Ld(m) to the first pixel circuit Pc1(*k*) through the switching transistor Ts1. In the example of display device 1, the pixel signal voltage Vsig is input to the source of the drive transistor Td. Then, since the drive transistor Td is diode-connected, a voltage "Vsig−Vth" that is shifted from the pixel signal voltage Vsig by the threshold voltage Vth of the drive transistor Td is applied to the gate node Ng of the drive transistor Td, so that a voltage "Vdd−(Vsig−Vth)" is stored in the signal storing capacitor Cs. Hereinafter, a period during which the pixel signal voltage is supplied from the signal line Ld to the pixel circuit Pc, that is, a period during which the switching transistors Ts1 and Ts2 are in the on-state is referred to as "signal converging period".

During the signal converging period, the closer to "Vsig−Vth" the potential of the gate node Ng of the drive transistor Td becomes, the closer to the off-state the drive transistor Td becomes. Therefore, the closer to "Vsig−Vth" the potential of the gate node Ng becomes, the more difficult the electric current is to flow between the source and the drain of the drive transistor Td. Accordingly, it takes relatively long time for the potential of the gate node Ng to reach "Vsig−Vth". With regard to the above matter, a sufficiently long period is necessary as the signal converging period for the potential of the gate node Ng to reach "Vsig−Vth". In the example of the display device 1, one horizontal scan period is secured as the signal converging period. On the other hand, a relatively short period is enough for inputting the pixel signal voltage Vsig to the signal line Ld from the drive IC 11. Accordingly, in the example of display device 1, the switching transistors Ts1 and Ts2 are controlled so that the signal converging period is longer than the signal writing period. In other words, the switching transistors Ts1 and Ts2 are controlled so that the signal converging period continues even after the signal writing period ends.

After the signal converging period, an off-voltage Voff is applied to the first scan line Ls(k), and an on-voltage Von is applied to the lightning scan line Le(k). As a result, as shown in FIG. 4C, the switching transistors Ts1 and Ts2 turns to the off-state, and the switching transistors Ts3 and Ts4 turns to the on-state. Therefore, the source of the drive transistor Td is connected to the power supply line Lv through the switching transistor Ts3, so that an electric current is supplied from the power supply line Lv to the light emitting element D through the switching transistors Ts3, Ts4, and through the drive transistor Td.

The electric current Id flowing between the source and the drain of the drive transistor Td is expressed by the following expression.

$$Id=K(Vgs-Vth)^2$$

In the above expression, K is a coefficient, and Vgs is the voltage between the gate and the source of the drive transistor Td.

As described above, at the end of the signal converging period, the potential of the gate node Ng of the drive transistor Td reaches "Vsig−Vth". Therefore, in the light emitting period, the voltage Vgs between the gate and the source of the drive transistor Td is expressed by the following expression.

$$Vgs=Vdd-(Vsig-Vth)$$

Therefore, the electric current Id is expressed by the following expression.

$$Id = K(Vdd-(Vsig-Vth)-Vth)^2$$
$$= K(Vdd-Vsig)^2$$

As indicated by the above expression, the electric current Id flowing between the source and the drain of the drive transistor Td corresponds to "Vdd−Vsig" which does not depend on the threshold voltage Vth. Note that the second pixel circuit Pc2 is operated in the same way as the first pixel circuit Pc1 shown in FIGS. 4A to 4C, except that the switching transistors Ts1, Ts2, Ts5, and Ts6 of the second pixel circuit Pc 2 are controlled by the second scan line Ls2.

[Method of Driving Pixel Circuit]

Figure 5:
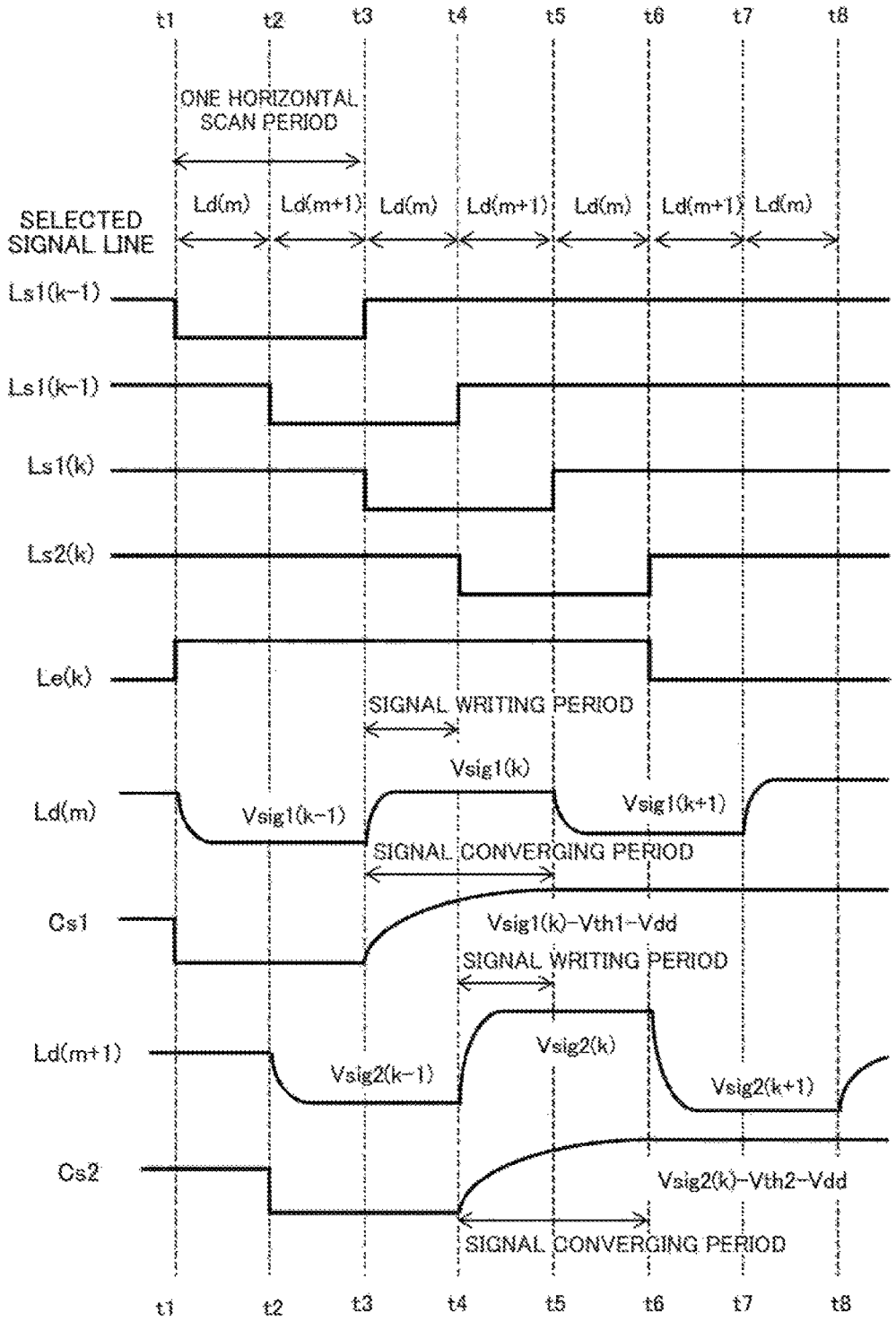
FIG. 5 is a timing chart showing a method of driving the pixel circuit.
Figure 6A:
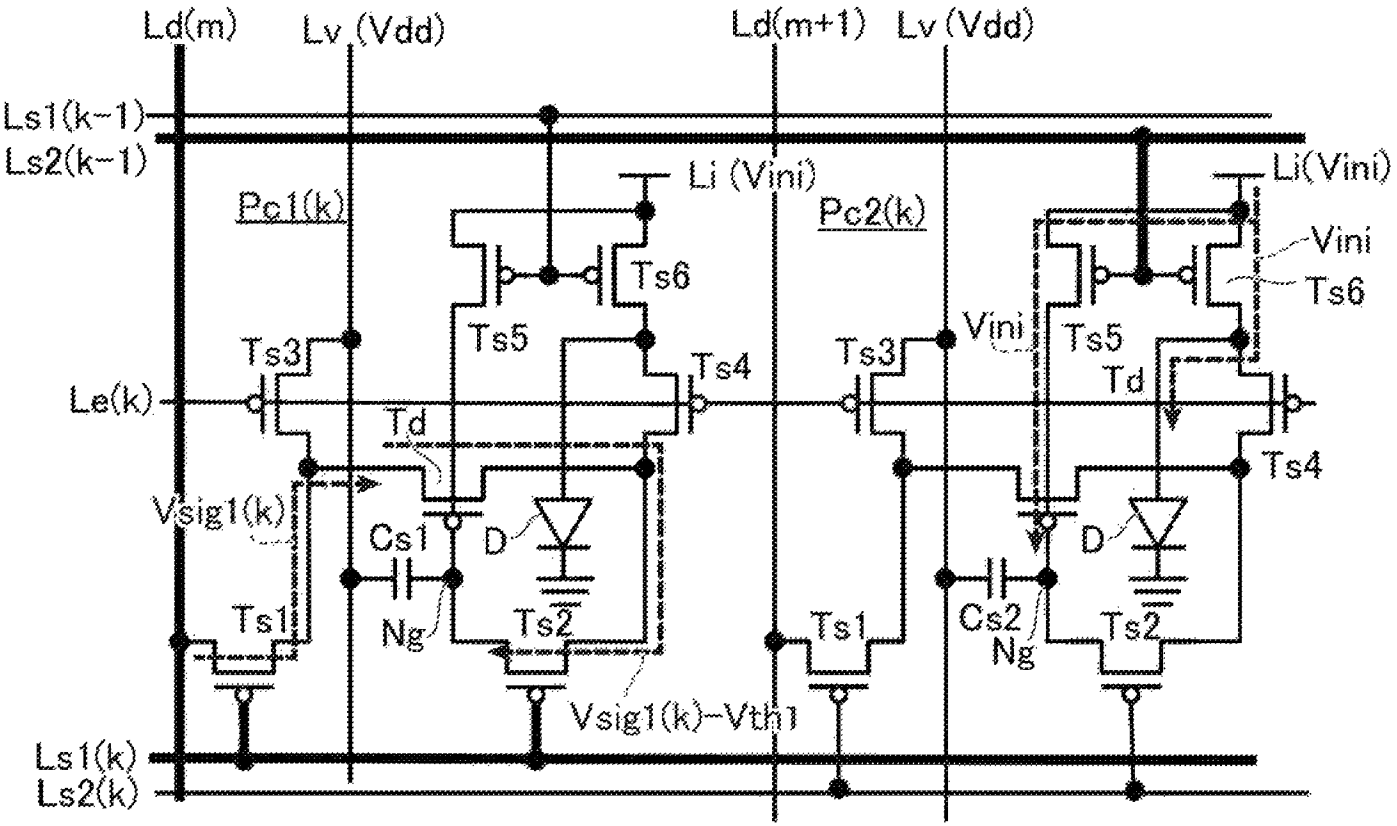
FIG. 6A shows the flows of a signal and an electric current in a period from t3 to t4 in FIG. 5.
Figure 6B:
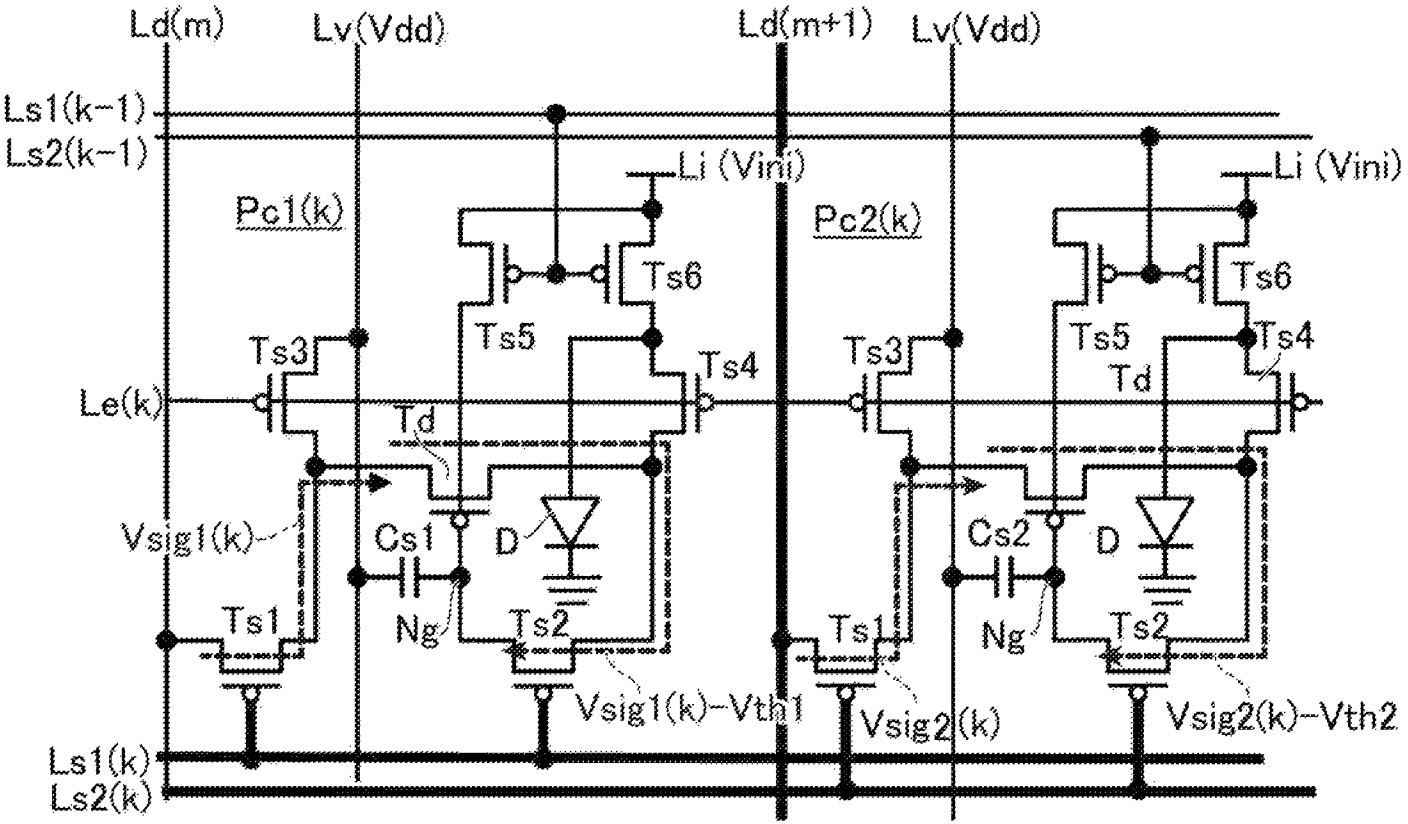
FIG. 6B shows the flows of a signal and an electric current in a period from t4 to t5 in FIG. 5.
Figure 6C:
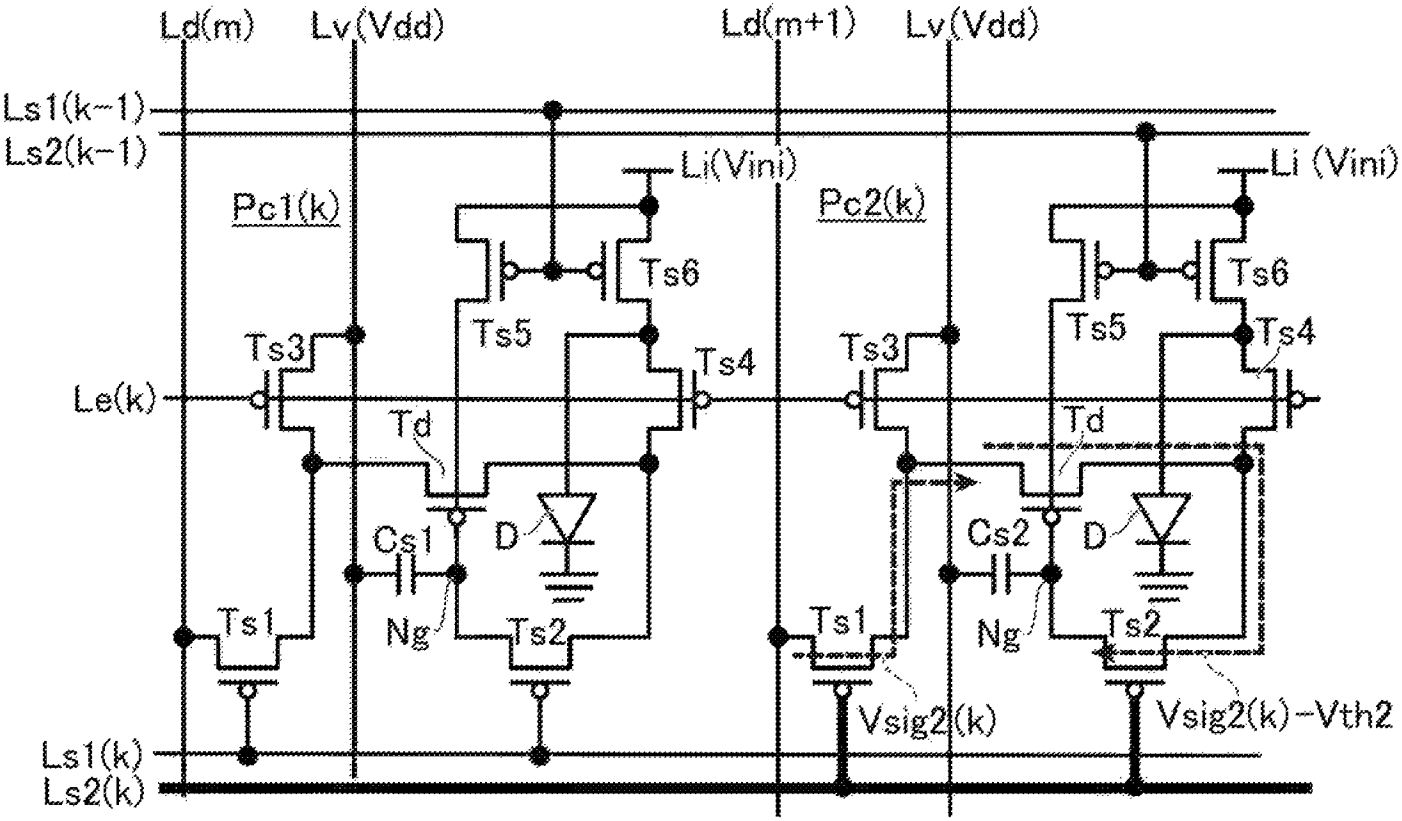
FIG. 6C shows the flows of a signal and an electric current in a period from t5 to t6 in FIG. 5.

FIG. 5 is a timing chart showing an exemplified method of driving the pixel circuit. This chart indicates the signal line selected in the signal line selection circuit 14, voltage of the scan line Ls, voltage of the lightning scan line Le, voltage of the first signal line Ld(m) and the second signal line Ld(m+1), and voltage of the signal storing capacitors Cs of the two pixel circuits Pc in a single pixel row. In this figure, the signal storing capacitor Cs of the first pixel circuit Pc1(*k*) is represented by "Cs1", and the signal storing capacitor Cs of the second pixel circuit Pc2(*k*) is represented by "Cs2". FIGS. 6A to 6D are for explaining signals and electric currents. FIG. 6A corresponds to the period from t3 to t4 of FIG. 5. FIG. 6B corresponds to the period from t4 to t5. FIG. 6C corresponds to the period from t5 to t6, and FIG. 6D corresponds to the period after t6 of FIG. 5. In FIG. 5, the pixel signal voltages supplied to the first pixel circuits Pc1(*k*−1), Pc1(*k*) and Pc1(*k*+1) are referred to as Vsig1(*k*−1), Vsig1(*k*) and Vsig1(*k*+1), respectively. Similarly, the pixel signal voltages supplied to the second pixel circuits Pc2(*k*−1), Pc2(*k*), and Pc2(*k*+1) are referred to as Vsig2(*k*−1), Vsig2(*k*) and Vsig2(*k*) and Vsig2 (*k*+1), respectively.

At time t1, the voltage of lightning scan line Le(k) switches from the on-voltage to the off-voltage. In addition, as shown in FIG. 4A, the on-voltage Von is applied to the first scan line Ls1(*k*−1) to turn the switching transistor Ts5 of the first pixel circuit Pc1(*k*) to the on-state. As a result, the initialization voltage Vini is applied to the one electrode of the signal storing capacitor Cs1, so that the signal storing capacitor Cs1 stores a voltage "Vini−Vdd". In addition, the switching transistor Ts6 turns to the on-state by the on-voltage Von of the first scan line Ls1(*k*−1), so that the initialization voltage Vini is applied to the light emitting element D of the first pixel circuit Pc1(*k*) to stop the light emitting element D from emitting light. The on-voltage Von is applied to the first scan line Ls1(*k*−1) until time t3. Accordingly, the period from t1 to t3 is the initialization period for the first pixel circuit Pc1(*k*).

Next, the on-voltage Von is applied to the second scan line Ls2(*k*−1) at time t2. As a result, the switching transistor Ts5 of the second pixel circuit Pc2(*k*) turns to the on-state, so that the initialization voltage Vini is applied to one electrode of the signal storing capacitor Cs 2. Accordingly, the signal storing capacitor Cs2 stores a voltage "Vini−Vdd". In addition, the switching transistor Ts6 turns to the on-state by the on-voltage Von of the second scan line Ls2(*k*−1), so that the initialization voltage Vini is applied to the second pixel circuit Pc2(*k*) to stop the light emitting element D of the second pixel circuit Pc2 from emitting light. The on-voltage Von is applied to the second scan line Ls2(*k*−1) until time t4. Therefore, the period from t2 to t4 is the initialization period for the second pixel circuit Pc2(*k*). In the example of the display device 1, t1 and t2 are shifted from each other by half of the one horizontal scan period. Therefore, the initialization periods of the first pixel circuit Pc1 and the second pixel circuit Pc2 are shifted from each other by half of the one horizontal scan period.

The signal line selection circuit 14 selects the first signal line Ld only during a partial period of one horizontal scan period. Only during this period, the pixel signal voltage Vsig for the first pixel circuit Pc1 is input from the drive IC 11 to the first signal line Ld. In the example shown in FIG. 5, in a period from t3 to t4 which is half of one horizontal scan period, the first signal line Ld(m) is selected by the signal line selection circuit 14 and the pixel signal voltage Vsig1(*k*) is input from the drive IC 11 to the first signal line Ld(m). That is, this period is the "signal writing period" for the first pixel circuit Pc1(*k*). By the end of this period, the voltage of the first signal line Ld(m) reaches the pixel signal voltage Vsig1(*k*).

As shown in FIG. 5, at the time 53, the off-voltage Voff is applied to the first scan line Ls1(*k*−1) and the on-voltage Von is applied to the first scan line Ls1(*k*). As a result, the switching transistors Ts1 and Ts2 of the first pixel circuit Pc1(*k*) turns to the on-state. Therefore, as shown in FIG. 6A, the pixel signal voltage Vsig1(*k*) is input to the source of the drive transistor Td from the first signal line Ld(m) through the switching transistor Ts1. Accordingly, as shown in FIG. 5, the voltage of the signal storing capacitor Cs1 gradually converges to "(Vsig1(*k*)−Vth1)−Vdd" ("Vth1" is the threshold voltage of the drive transistor Td of the first pixel circuit Pc1(*k*).)

In the example, of display device 1, applying the pixel signal voltage Vsig1(*k*) from the drive IC 11 to the first signal line Ld(m) starts at the time t3, and at the same time, the on-voltage Von is applied to the first scan line Ls1. That is, applying the pixel signal voltage Vsig1(k) from the drive IC 11 to the first signal line Ld(m) and applying the pixel signal voltage Vsig1(k) from the first signal line Ld(m) to the first pixel circuit Pc1(k) from the first signal line Ld(m) to the first pixel circuit Pc1(k) start simultaneously. In other words, the start of the signal converging period is synchronized with the start of the signal writing period. However, the starts of these two periods may not be exactly the same.

As shown in FIG. 5, at the time t4, the signal line selection circuit 14 selects the second signal line Ld(m+1) instead of the first signal line Ld(m), so that applying the pixel signal voltage Vsig1(k) to the first signal line Ld (m) ends at the time t4. However, the capacity of each signal line Ld is sufficiently larger than the capacity of the signal storing capacitor Cs. Therefore, the voltage of the first signal line Ld(m) is maintained at the pixel signal voltage Vsig1(k) in the period after the time t4, specifically during the period from t4 to t5.

As shown in FIG. 5, the application of the on-voltage Von to the first scan line Ls1(k) continues after the end (at the time t4) of selecting the first signal line Ld(m). Therefore, as shown in FIG. 6B, the on-state of the switching transistors Ts1 and Ts2, in other words, the input of the pixel signal voltage Vsig1(k) from the first signal line Ld (m) to the first pixel circuit Pc1 (k) continues longer than the period (signal writing period) in which the first signal line Ld (m) is selected. As a result, the voltage of the signal storing capacitor Cs1 can sufficiently converge to "(Vsig1(k)−Vth1)−Vdd". In the example of display device 1, applying the on-voltage Von to the first scan line Ls1(k) ends at time t5. Accordingly, the period from t3 to t5 is the "signal converging period" for the first pixel circuit Pc1(k).

The signal line selection circuit 14 selects the second signal line Ld only during a partial portion of one horizontal scan period. Accordingly, only during this period, the pixel signal voltage Vsig2 for the second pixel circuit Pc2 is input from the drive IC 11 to the second signal line Ld. In the example shown in FIG. 5, during the period from t4 to t5 which is half of one horizontal scan period, the second signal line Ld(m+1) is selected, so that the pixel signal voltage Vsig2(k) for the second pixel circuit Pc2 is input to the second signal line Ld(m+1). That is, this period is the "signal writing period" for the second pixel circuit Pc2(k). By the end of this period, the voltage of the second signal line Ld(m+1) reaches the pixel signal voltage Vsig2(k).

As described above, the signal writing period of the first pixel circuit Pc1 ends at the time t4. Accordingly, the signal writing period for the first pixel circuit Pc1(k) and the signal writing period for the second pixel circuit Pc2(k) do not overlap with each other. Note that there may be temporal differences between the two signal writing periods. That is, the start of the signal writing period for the second pixel circuit Pc2(k) may not be simultaneous with the end of the signal writing period for the first pixel circuit Pc1(k).

As shown in FIG. 5, at the time t4, the off-voltage Voff is applied to the second scan line Ls2(k−1) and the on-voltage Von is applied to the second scan line Ls2(k). As a result, the switching transistors Ts1 and Ts2 of the second pixel circuit Pc2(k) turn to the on-state. Therefore, as shown in FIG. 6B, the pixel signal voltage Vsig2(k) is input to the source of the drive transistor Td from the second signal line Ld(m+1) through the switching transistor Ts1. As a result, as shown in FIG. 5, the voltage of the signal storing capacitor Cs2 gradually converges to "(Vsig2(k)−Vth2)−Vdd". ("Vth2" is the threshold voltage of the drive transistor Td of the second pixel circuit Pc2(k).)

In the example of the display device 1, the pixel signal voltage Vsig2(k) stars to be input from the drive IC 11 to the second signal line Ld(m+1) at the time t4, and at the same time, the on-voltage Von is applied to the second scan line Ls2. That is, the input of the pixel signal voltage Vsig2 (k) to the second signal line Ld(m+1) and the input of the pixel signal voltage Vsig2(k) from the second signal line Ld(m+1) to the second pixel circuit Pc2 start simultaneously. That is, the start of the signal converging period is synchronized with the start of the signal writing period. However, the start of these two periods may not be exactly the same.

As shown in FIG. 5, at the time t5, the signal line selection circuit 14 selects the first signal line Ld(m) instead of the second signal line Ld(m+1). As a result, applying the pixel signal voltage Vsig2(k) to the second signal line Ld(m+1) ends at the time t5. However, as described above, the capacity of the signal line Ld is sufficiently larger than the capacity of the signal storing capacitor Cs. Therefore, the voltage of the second signal line Ld(m+1) is maintained at the pixel signal voltage Vsig2(k) during the period after t5, specifically during the period from t5 to t6.

The on-voltage Von continues being applied to the second scan line Ls2(k) even after the end (at the time t5) of selecting the second signal line Ld(m+1). That is, as shown in FIG. 6C, the on-state of the switching transistors Ts1 and Ts2, that is, the input of the pixel signal voltage Vsig2(k) from the second signal line Ld(m+1) to the second pixel circuit Pc2(k) continues after the end of selecting the second signal line Ld(m+1), thereby having a longer period than the period (signal writing period) in which the second signal line Ld(m+1) is selected. As a result, the voltage of the signal storing capacitor Cs2 can sufficiently converge to "(Vsig2 (k)−Vth2)−Vdd". In the example of display device 1, the application of the on-voltage Von to the second scan line Ls2(k) ends at the time t6. Accordingly, the period from t4 to t6 is the "signal converging period" for the second pixel circuit Pc2(k). "Signal converging period" for first pixel circuit Pc1(k) and "signal converging period" for second pixel circuit Pc2(k) have the same length.

Figure 6D:
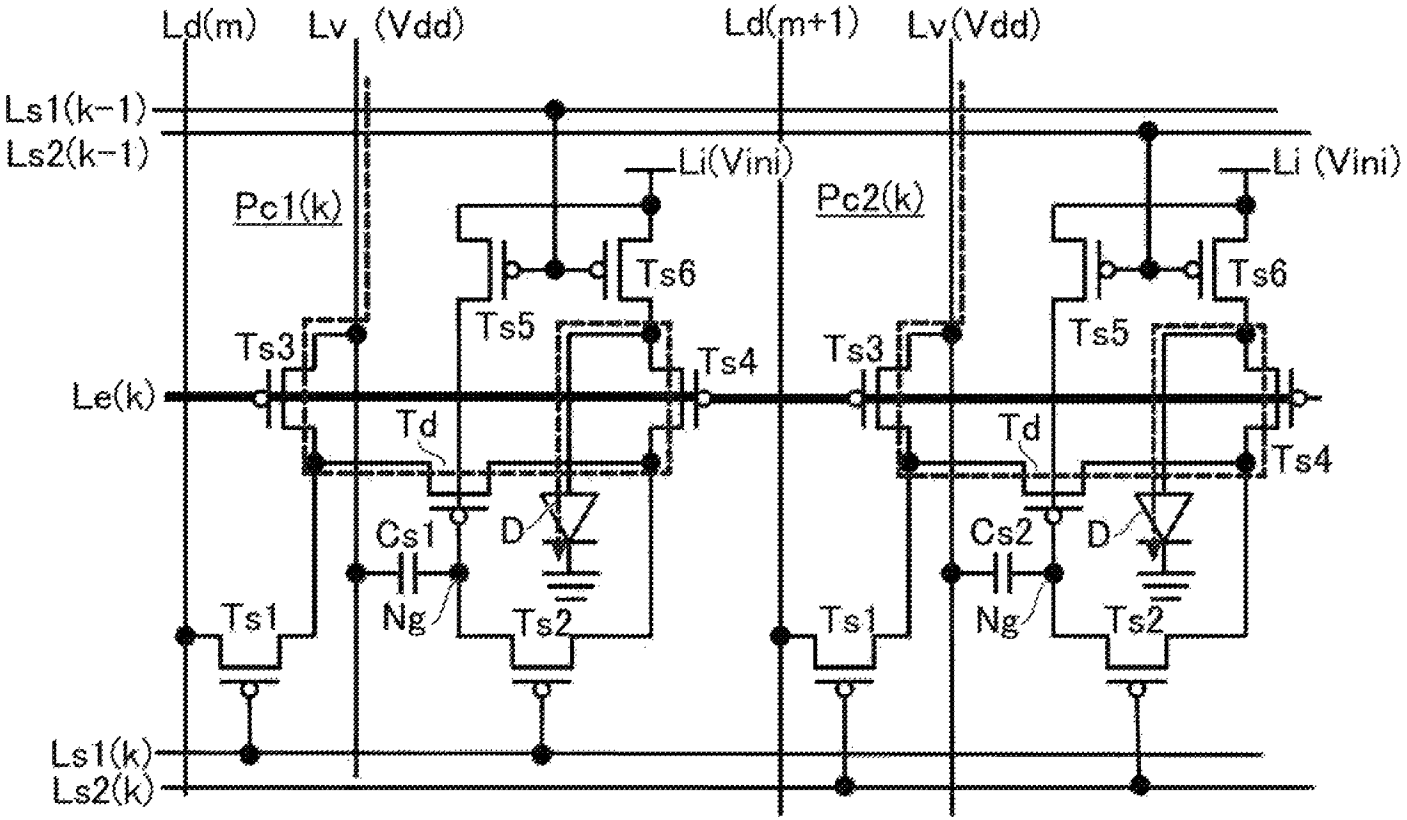
FIG. 6D shows the flows of a signal and an electric current in a period from t6 to t7 in FIG. 5.

As shown in FIG. 5, at time t6, the off-voltage Voff is applied to the second scan line Ls(k) and the on-voltage Von is applied to the lightning scan line Le(k). As a result, as shown in FIG. 6D, the light emitting element D of the first pixel circuit Pc1(k) is connected to the power supply line Lv through the switching transistors Ts3 and Ts4 and the drive transistor Td, so that an electric current is supplied to the light emitting element D. At the same time, the light emitting element D of the second pixel circuit Pc2(k) is connected to the power supply line Lv through the switching transistors Ts3 and Ts4 and the drive transistor Td, so that an electric current is supplied to the light emitting element D. Supply of the electric current is maintained until the start (at the time t1) of the initialization period of the next frame period.

As described above, in the example of display device 1, the two signal lines Ld are connected to the single output terminal 11a of the drive IC 11. Therefore, one horizontal scan period has two signal writing periods defined therein that do not overlap with each other. In the example of display device 1, the signal writing period is half of the one horizontal scan period. Unlike the example of display device 1, the signal writing period may be shorter than half of the one horizontal scan period.

Each of the signal converging periods for the pixel circuits Pc1 and Pc2 has twice the length of the signal writing period. Therefore, each of the two signal converging periods has the same length as the one horizontal scan period. Also, the two signal converging periods partially overlap with each other.

In the example of FIG. 5, the two signal converging periods overlap with each other in the period from t4 to t5 in which the on-voltage is applied to both the first scan line Ls1(*k*) and the second scan line Ls2(*k*). Unlike the example of display device 1, each signal converging period may be shorter than twice the signal writing period, being longer than the signal writing period. In other words, each signal converging period may be shorter than one horizontal scan period, being longer than the signal writing period.

As will be described later, the number of the signal lines Ld connected to each output terminal 11*a* may not be two. For example, the number of the signal lines Ld connected to each output terminal 11*a* may be three. In this case, three signal writing periods which do not overlap with each other are defined in one horizontal scan period. Each signal writing period is, for example, one third of the one horizontal scan period. Further, the signal converging period is, for example, three times as long as the signal writing period (that is, the signal converging period has the same length as one horizontal scan period). The signal converging period may be shorter than three times the signal writing period, being longer than the signal writing period. In short, when n signal writing periods not overlapping with each other are defined in one horizontal scan period, each signal converging period is n times as long as the signal writing period, or shorter than n times the signal writing period, being longer than the signal writing period ("n" is a natural number of 2 or more). In yet another example, four signal writing periods not overlapping each other may be defined in one horizontal scan period.

The present invention is not limited to the above-described examples, and may be modified variously.

[First Modification of Pixel Circuit]

Figure 7:
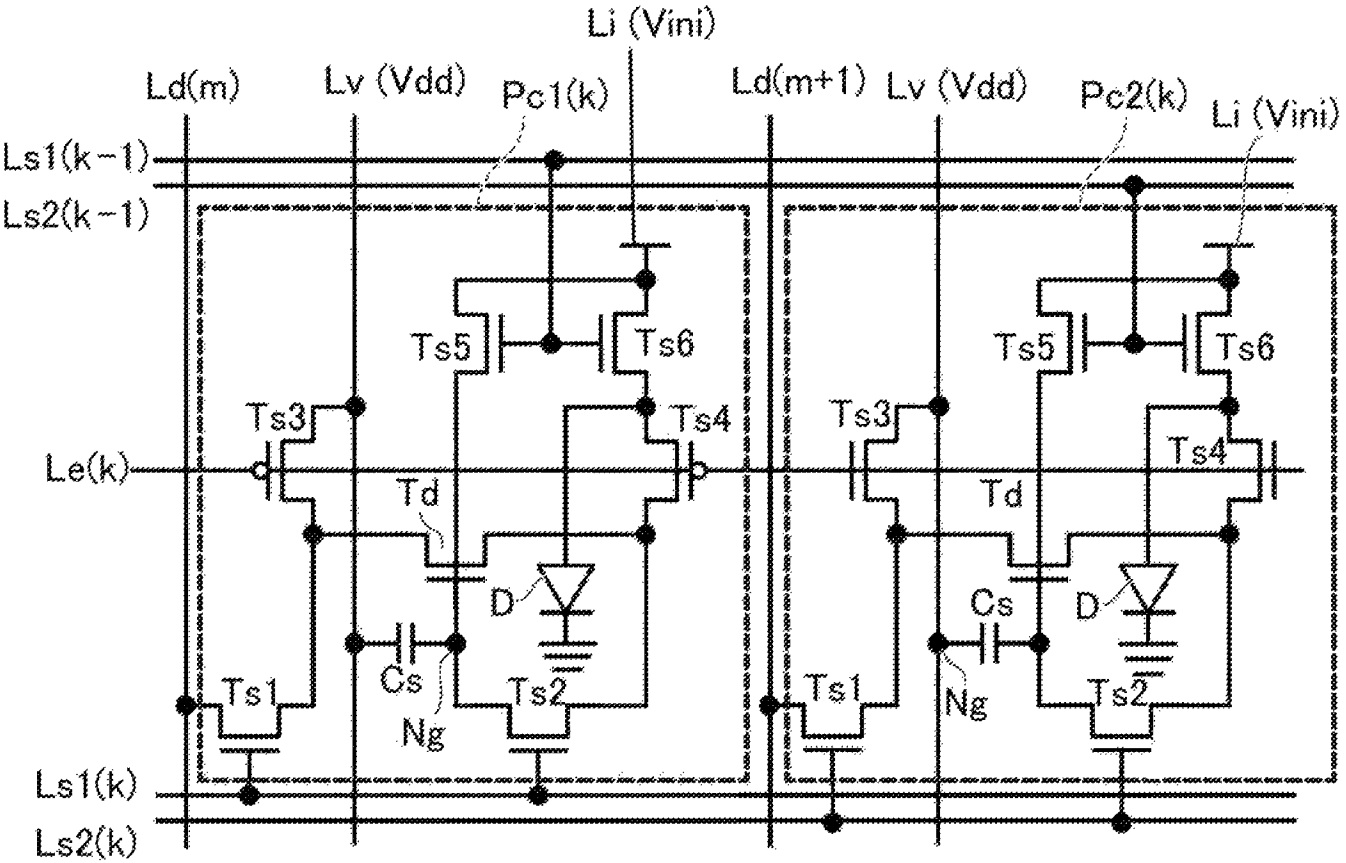
FIG. 7 is a circuit diagram showing a modified example of the pixel circuit.

FIG. 7 shows a modified example of the pixel circuit Pc. Unlike the switching transistors in the pixel circuits Pc1 and Pc2 shown in FIG. 3, the switching transistors Ts1, Ts2, Ts5, and Ts6 in the pixel circuits Pc1 and Pc2 exemplified in FIG. 7 are NMOS transistors. In this case, a high voltage is applied to the scan lines Ls as the on-voltage Von, and a low voltage is applied as the off-voltage Voff. The pixel circuits Pc1 and Pc2 in FIG. 7 is the same as those in FIG. 3 in other respects.

The NMOS transistor may employ an oxide semiconductor transistor made of oxide semiconductor. Since the oxide semiconductor transistor has wide band gap of the semiconductor, low hall mobility of the semiconductor, and small leakage of electric current in the off state thereof. The switching transistors Ts1, Ts2, Ts5, and Ts6 that are oxide semiconductor transistors can reduce leakage of electric changes stored in signal storing capacitor Cs. As a result, the display device can be driven at a frame frequency lower than the general frame frequency (60 Hz). On the other hand, electric current for light emission flows through the switching transistors Ts3, Ts4 and the drive transistor Td, which employ PMOS transistors. Assuming those transistors employ oxide semiconductor transistors, there may be a problem that the electric current for light emission deteriorates those transistors. Therefore, the switching transistors Ts3, Ts4, and the drive transistor Td may employ a transistor that includes a semiconductor layer made of low temperature polycrystalline silicon (LPTS).

[Second Modification of Pixel Circuit]

Figure 8:
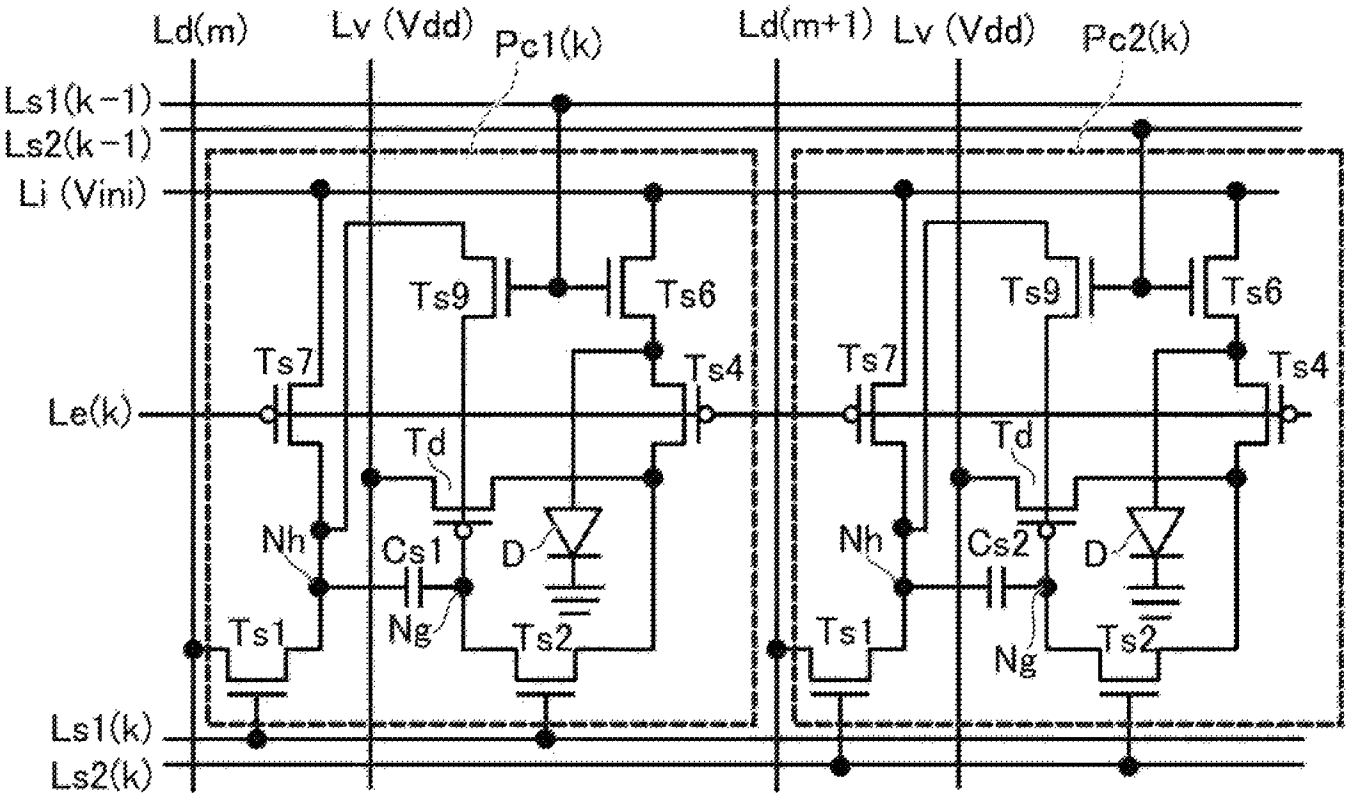
FIG. 8 is a circuit diagram showing still another modified example of the pixel circuit.

FIG. 8 shows still another modified example of the pixel circuit Pc. In the pixel circuit shown in this figure, the same elements and lines as those described above have the same symbols as those described above. Hereinafter, will be described features different from the pixel circuit Pc described in FIG. 3. Features not described with regard to the pixel circuit Pc in FIG. 8 are the same as those in the example of FIG. 3. FIG. 8 exemplifies the first pixel circuit Pc1(*k*) and the second pixel circuit Pc2(*k*). Hereinafter, the symbols Pc1 and Pc2 (without the suffix (k)) will be used for the pixel circuits in following explanations in which the plurality of pixel rows are not distinguished from one another. Further, the symbol Pc (without suffixes "1" or "2") will be used for the pixel circuits in explanations in which the two circuits are not distinguished from one another.

Like the pixel circuit Pc in the example of FIG. 3, each pixel circuit Pc exemplified in FIG. 8 has a light emitting element D, a drive transistor Td, and switching transistors Ts1 and Ts2. In the example of this figure, the source of the drive transistor Td is connected to the power supply line Lv. A plurality of scan lines Ls are provided for each pixel row. In detail, two scan lines Ls1 and Ls2 are provided for each pixel row. The gates of the switching transistors Ts1 and Ts2 in the first pixel circuit Pc1(*k*) are connected to the first scan line Ls1(*k*). The gates of the switching transistors Ts1 and Ts2 in the second pixel circuit Pc2(*k*) are connected to the second scan line Ls2(*k*). The circuit exemplified in FIG. 8 has NMOS transistors as the switching transistors Ts1 and Ts2, similarly to the circuit of the example of FIG. 7.

Like the pixel circuit Pc in the example of FIG. 3, the pixel circuit Pc exemplified in FIG. 8 includes the switching transistor Ts4. Further, the pixel circuit Pc exemplified in FIG. 8 has a switching transistor Ts7. The gates of the switching transistors Ts4 and Ts7 are connected to the lightning scan line Le. One electrode of the signal storing capacitor Cs is connected to a node Nh between the switching transistor Ts1 and the switching transistor Ts7. Therefore, this electrode of the signal storing capacitor Cs is connected to the initialization voltage line Li through the source and drain of the switching transistor Ts7 and connected to the signal line Ld through the source and drain of the switching transistor Ts1. The other electrode of the signal storing capacitor Cs is connected to the gate node Ng of the drive transistor Td. Although the switching transistors Ts4 and Ts7 are PMOS transistors, they may be NMOS transistors.

Like the pixel circuit Pc in the example of FIG. 3, the pixel circuit Pc in the example of FIG. 8 includes the switching transistor Ts6. Further, the pixel circuit Pc in the example of FIG. 8 includes a switching transistor Ts9. The gates of the switching transistors Ts6 and Ts9 are connected to the scan line of the immediately previous pixel row. In detail, the gates of the switching transistors Ts6 and T9 in the first pixel circuit Pc1(*k*) are connected to the first scan line Ls1(*k*−1), and the gates of the switching transistors Ts6 and Ts9 in the second pixel circuit Pc2(*k*) are connected to the second scan line Ls2(*k*−1). The gate node Ng of the drive transistor Td and the node Nh are connected to each other through the source and drain of the switching transistor Ts9. In other words, the two electrodes of the signal storing capacitor Cs are connected with each other through the source and drain of the switching transistor Ts9. The switching transistors Ts6 and Ts9 in FIG. 8 are NMOS transistors, but they may be PMOS transistors.

[Pixel Circuit Operation]

Figure 9A:
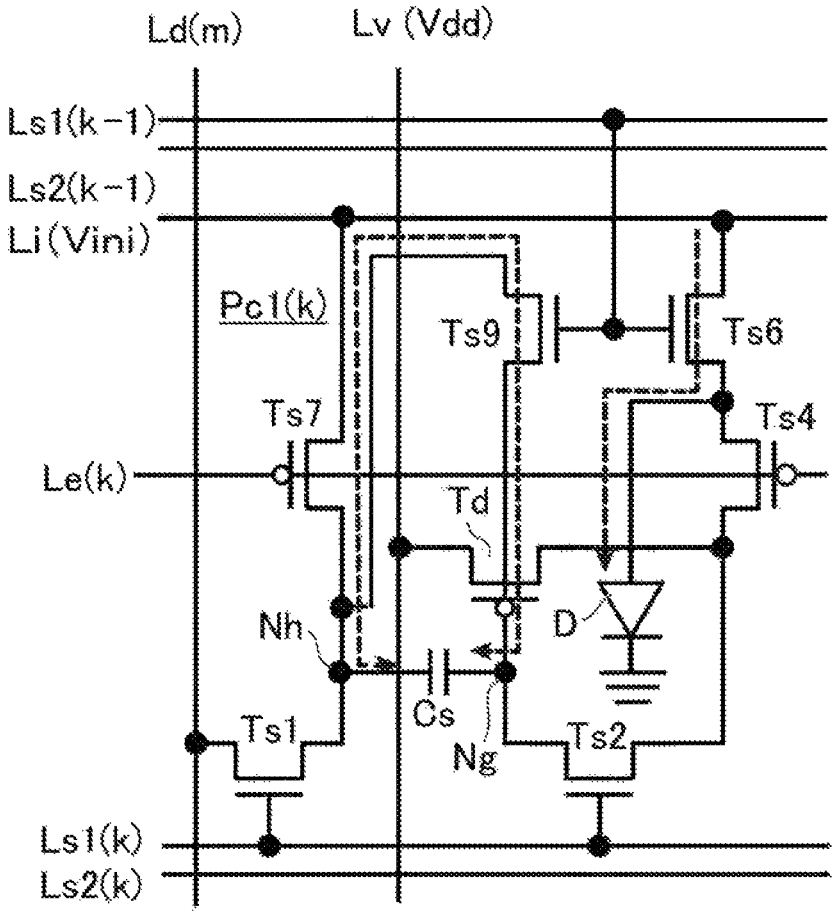
FIG. 9A is for explaining an initialization period.
Figure 9B:
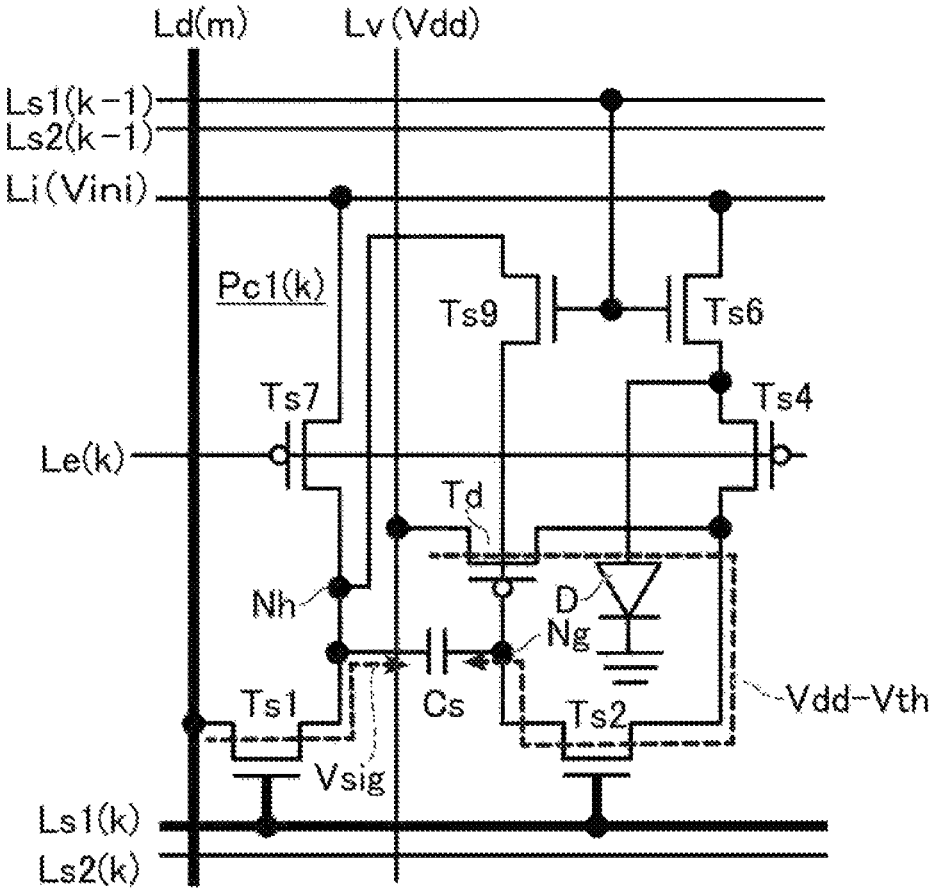
FIG. 9B is for explaining a signal writing period and an signal converging period.
Figure 9C:
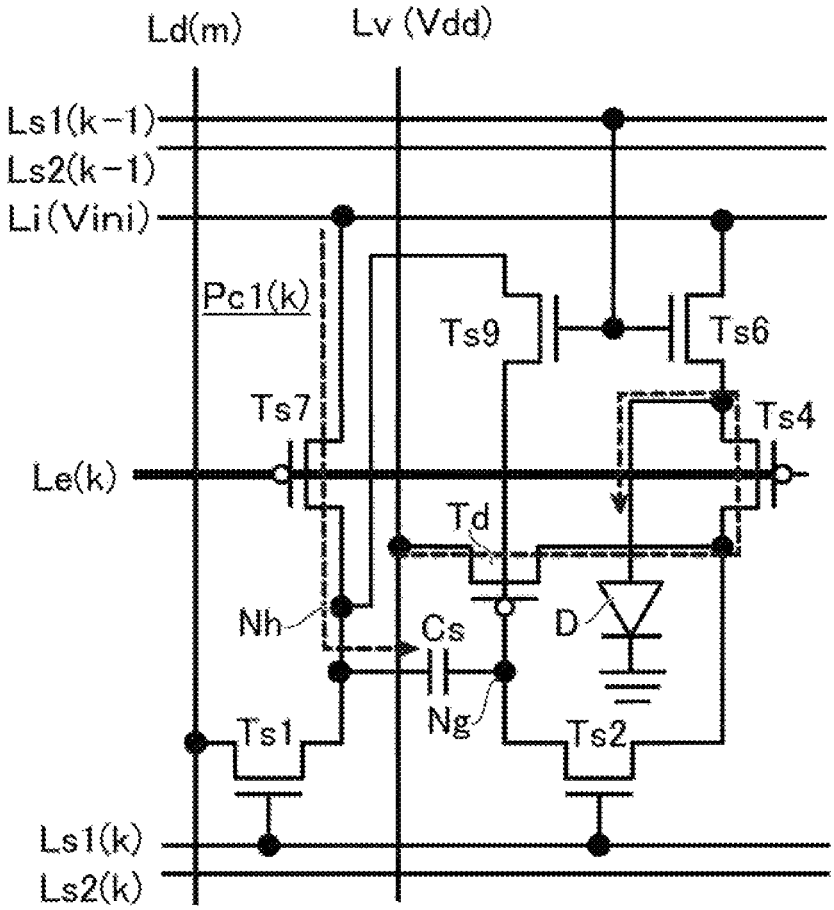
FIG. 9C is for explaining a light emitting period.

FIGS. 9A to 9C are for explaining the operation of the pixel circuits Pc shown in FIG. 8. FIG. 9A is for explaining the initialization period. FIG. 9B is for explaining the signal writing period and the signal converging period. FIG. 9C is for explaining the light emitting period. The operation of the first pixel circuit Pc1(*k*) out of the plurality of pixel circuits will be described as an example. Since the switching transistors Ts1, Ts2, Ts6, and Ts9 in the example of FIG. 8 are NMOS transistors, the off-voltage Voff is a low voltage, and the on-voltage Von is a high voltage higher than the low voltage. In addition, since the switching transistors Ts7 and Ts4 are PMOS transistors, the off-voltage Voff is a high voltage, and the on-voltage Von is a low voltage lower than the high voltage.

As shown in FIG. 9A, in the initialization period, the off-voltage Voff is applied to the lightning scan line Le(k), and the on-voltage Von is applied to the first scan line Ls($k$−1). Therefore, the switching transistor Ts6 turns to the on-state, so that the light emitting element D stops emitting light. Further, the switching transistor Ts9 turns to the on-state, so that the voltage stored in the signal storing capacitor Cs is canceled.

As shown in FIG. 9B, after the initialization period, the pixel signal voltage Vsig is input to the first signal line Ld(m) from the drive IC 11 through the signal line selection circuit 14, so that the pixel signal voltage Vsig is stored in the first signal line Ld(m). As described above, the period during which the pixel signal voltage Vsig is input to the signal line Ld is "signal writing period".

After the initialization period, the on-voltage Von is applied to the first scan line Ls(k), so that the switching transistor Ts1 turns to the on-state. As a result, the pixel signal voltage Vsig is input to the electrode on the node Nh side of the signal storing capacitor Cs. In addition, the switching transistor Ts2 turns to the on-state by the on-voltage Von of the first scan line Ls(k), so that the drain and the gate of the drive transistor Td are connected with each other through the switching transistor Ts2. Further, the source of the drive transistor Td is connected to the power supply line Lv. Therefore, a voltage shifted from the power supply voltage Vdd by the threshold voltage Vth, that is, "Vdd−Vth" is applied to the electrode on the gate node Ng side of the signal storing capacitor Cs. As a result, the signal storing capacitor Cs stores "(Vdd−Vth)−Vsig". As described above, "signal converging period" is the period during which the pixel signal voltage Vsig is input from the signal line Ld to the pixel circuit Pc.

Similarly to in the example of FIG. 3, the closer to "Vdd−Vth" the potential of the gate node Ng of the drive transistor Td becomes, the closer to the off-state the drive transistor Td becomes and thus the more difficult the electric current is to flow between the source and the drain of the drive transistor Td. Accordingly, it takes relatively long time for the potential of the gate node Ng to reach "Vdd−Vth". That is, it takes relatively long time for the voltage stored in the signal storing capacitor Cs to reach "(Vdd−Vth)−Vsig". With regard to the above matter, a sufficiently long period is necessary as the signal converging period for the potential of the gate node Ng to reach "Vdd−Vth". In an example, one horizontal scan period is secured as the signal converging period. On the other hand, a relatively short period is enough for inputting the pixel signal voltage Vsig to the signal line Ld from the drive IC 11. Accordingly, in the example of display device 1, the switching transistors Ts1 and Ts2 exemplified in FIG. 8 are controlled so that the signal converging period is longer than the signal writing period. In other words, the switching transistors Ts1 and Ts2 are controlled so that the signal converging period continues even after the signal writing period ends.

After the signal converging period, the off-voltage Voff is applied to the first scan line Ls(k) and the on-voltage Von is applied to the lightning scan line Le(k). As a result, as shown in FIG. 9C, the switching transistors Ts1 and Ts2 turn to the off-state, and the switching transistors Ts7 turns to the on-state. Therefore, the potential of the node Nh changes from Vsig to Vini. At this time, since the signal storing capacitor Cs stores "(Vdd−Vth)−Vsig", the potential of the gate node Ng changes according to the potential change of the node Nh. That is, assuming that the potential change of the node Nh is ΔV (ΔV=Vini−Vsig), the potential of the gate node Ng is "Vdd−Vth+ΔV". As described above, the electric current Id flowing between the source and the drain of the drive transistor Td is expressed by the following expression.

$$Id=K(Vgs-Vth)^2$$

Therefore, in the example of FIG. 8, the electric current Id flowing between the source and the drain of the drive transistor Td is expressed by the following expression.

$$\begin{aligned} Id &= K(Vdd-(Vdd-Vth+\Delta V)-Vth)^2 \\ &= K(\Delta V)^2 \\ &= K(Vini-Vsig)^2 \end{aligned}$$

As indicated by the above expression, the electric current Id flowing between the source and the drain of the drive transistor Td corresponds to "Vini−Vsig" which does not depend on the threshold voltage Vth. In the example of FIG. 3, since the electric current corresponding to "Vdd−Vsig" is supplied to the light emitting element D, the pixel signal voltage Vsig needs to be close to the power supply voltage Vdd, which is relatively high. On the other hand, in the example of FIG. 8, since an electric current corresponding to "Vini−Vsig" is supplied to the light emitting element D, the pixel signal voltage can be close to the initialization voltage Vini, which is relatively low.

[Method of Driving Pixel Circuit]

Figure 10:
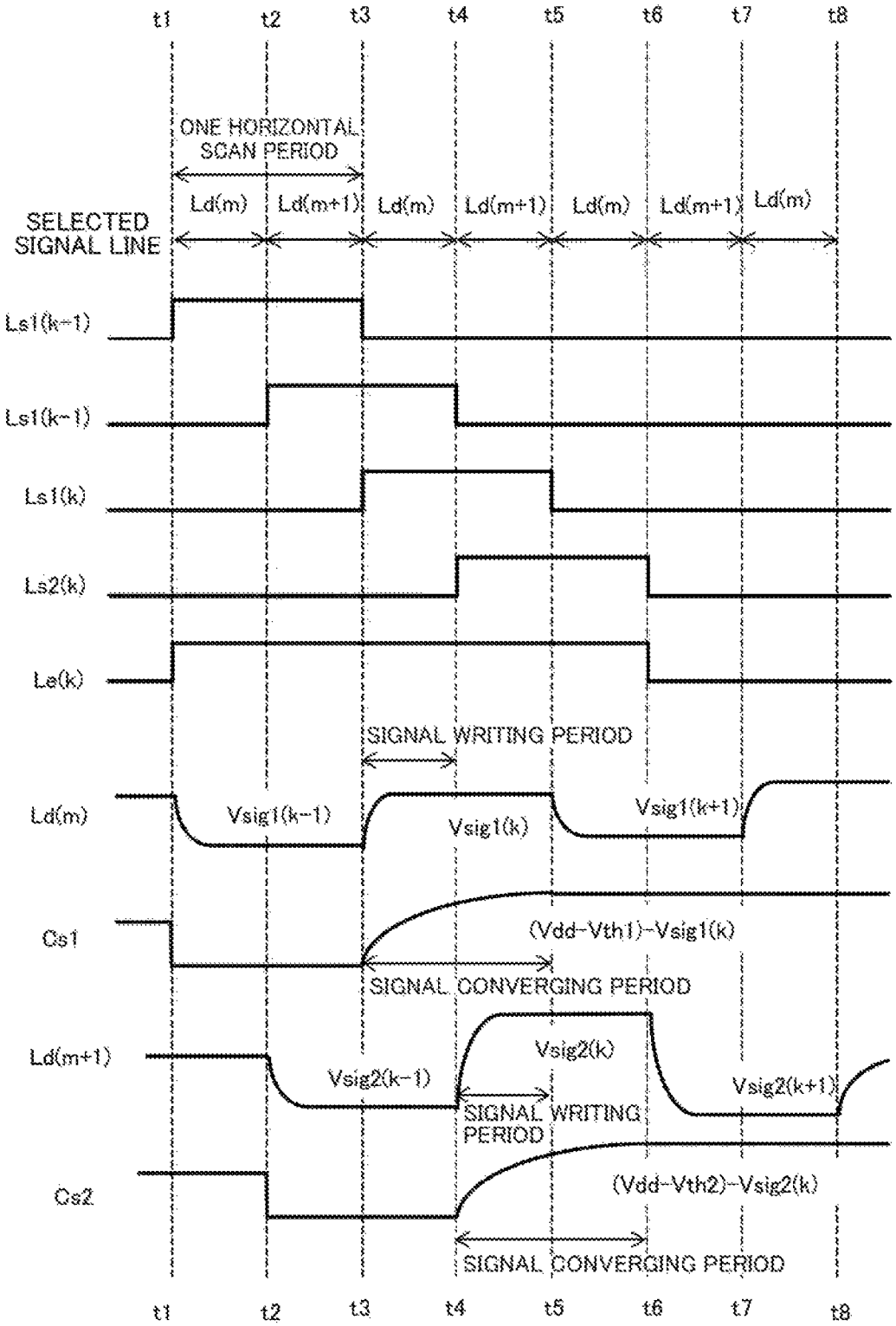
FIG. 10 is a timing chart showing a method of driving the pixel circuit shown in FIG. 8.

FIG. 10 is a timing chart showing the method of driving the pixel circuit shown in FIG. 8. This figure indicates the signal line selected by the signal line selection circuit 14, the voltage of the scan line Ls, the voltage of the lightning scan line Le, the voltage of the first signal line Ld(m), the voltage of the second signal line Ld(m+1), the voltage of the signal storing capacitor Cs. In this figure, the signal storing capacitor Cs of the first pixel circuit Pc1($k$) is represented by a symbol "Cs1", and the signal storing capacitor Cs of the second pixel circuit Pc2($k$) is represented by a symbol "Cs2".

At time t1, the voltage of the lightning scan line Le(k) switches from the on-voltage to the off-voltage. In addition, the on-voltage Von is applied to the first scan line Ls1($k$−1). Thereby, the switching transistor Ts9 of the first pixel circuit Pc1($k$) turns to the on-state, so that the voltage stored in the signal storing capacitor Cs1 is canceled. In addition, the switching transistor Ts6 turns to the on-state by the on-voltage Von of the first scan line Ls1($k$−1), so that the light emitting element D stops emitting light. The on-voltage Von is applied to the first scan line Ls1($k$−1) until time t3. Accordingly, the period from t1 to t3 is the initialization period of the first pixel circuit Pc1($k$).

Next, at time t2, the on-voltage Von is applied to the second scan line Ls2($k$−1). Thereby, the switching transistor Ts9 of the second pixel circuit Pc2($k$) turns to the on-state, so that the voltage stored in the signal storing capacitor Cs 2 is canceled. In addition, the switching transistor Ts6 turns to the on-state by the on-voltage Von of the second scan line Ls2($k$−1), so that the light emitting element D stops emitting light. The on-voltage Von is applied to the second scan line Ls2(k−1) until time t4. Therefore, the period from t2 to t4 is the initialization period for the second pixel circuit Pc2(k).

As shown in FIG. 10, the signal line selection circuit 14 selects the first signal line Ld(m) in the period from t3 to t4 which is half of one horizontal scan period, so that the pixel signal voltage Vsig1(k) for the first pixel circuit Pc1(K) is input to the first signal line Ld(m) from the drive IC 11. That is, this period is the "signal writing period" for the first pixel circuit Pc1(k). By the end of this period, the voltage of the first signal line Ld(m) reaches the pixel signal voltage Vsig1(k).

Also, at the time t3, the off-voltage Voff is applied to the first scan line Ls1(k−1) and the on-voltage Von is applied to the first scan line Ls1(k). As a result, the switching transistor Ts1 of the first pixel circuit Pc1(k) turns to the on-state, so that the pixel signal voltage Vsig1(k) is input to the electrode on the node Nh side of the signal storing capacitor Cs1 from the first signal line Ld(m) through the switching transistor Ts1. Further, the switching transistor Ts2 of the first pixel circuit Pc1(k) turns to the on-state by the on-voltage Von of the first scan line Ls1(k), so that the potential of the gate node Ng approaches "Vdd−Vth1" gradually. Therefore, as shown in FIG. 10, the voltage of the signal storing capacitor Cs1 converges to "(Vdd−Vth1)−Vsig1(k)". Inputting the pixel signal voltage Vsig1(k) from the drive IC 11 to the first signal line Ld(m) is started at the time t3, and at the same time the on-voltage Von is applied to the first scan line Ls1(k). That is, the input the pixel signal voltage Vsig1(k) and the application of the on-voltage Von is applied to the first scan line Ls1(k). That is, the input the pixel signal voltage Vsig1(k) and the application of the on-voltage Von are simultaneously started. However, those may not start at the same time.

As shown in FIG. 10, at time t4, the selection by the signal line selection circuit 14 is switched from the first signal line Ld(m) to the second signal line Ld(m+1). As a result, Input of the pixel signal voltage Vsig1(k) to the first signal line Ld(m) ends at the time t4. However, the capacity of the signal line Ld is sufficiently larger than the capacity of the signal storing capacitor Cs. Therefore, the voltage of the first signal line Ld(m) is maintained at the pixel signal voltage Vsig1(k) during the period after the time t4, more specifically during the period from t4 to t5.

The application of the on-voltage Von to the first scan line Ls1(k) continues after the end (at the time t4) of selecting the first signal line Ld(m). Therefore, the on-state of the switching transistors Ts1 and Ts2, in other words, the input of the pixel signal voltage Vsig1(k) from the first signal line Ld(m) to the first pixel circuit Pc1(k) continues after the end (at the time t4) of selecting the first signal line Ld(m) to last longer than the signal writing period in which the first signal line Ld(m) is selected. As a result, the voltage stored in the signal storing capacitor Cs can sufficiently reach "(Vdd−Vth1)−Vsig1(k)". The application of the on-voltage Von to the first scan line Ls1(k) ends at time t5. Therefore, the period from t3 to t5 is the "signal converging period" for the first pixel circuit Pc1(k).

In the period from t4 to t5, the signal line selection circuit 14 selects the second signal line Ld(m+1), so that the pixel signal voltage Vsig2(k) for the second pixel circuit Pc2(k) is input from the drive IC 11 to the second signal line Ld(m+1). That is, this period is the "signal writing period" for the second pixel circuit Pc2(k). By the end of this period, the voltage of the second signal line Ld(m+1) reaches the pixel signal voltage Vsig2(k).

As shown in FIG. 10, at the time t4, the off-voltage Voff is applied to the second scan line Ls2(k−1) and the on-voltage Von is applied to the second scan line Ls2(k). As a result, the switching transistor Ts1 of the second pixel circuit Pc2(k) turns to the on-state, so that the pixel signal voltage Vsig2(k) is input from the second signal line Ld(m+1) to the electrode on the node Nh side of the signal storing capacitor Cs2 through the switching transistor Ts1. In addition, the switching transistor Ts2 of the second pixel circuit Pc2(k) turns to the on-state by the on-voltage Von of the second scan line Ls2(k). As a result, the potential of the gate node Ng approaches "Vdd−Vth2" gradually, so that the voltage of the signal storing capacitor Cs2 gradually converges to "(Vdd−Vth2)−Vsig2(k)".

As shown in FIG. 10, at time t5, the selection of the signal line selection circuit 14 is switched from the second signal line Ld(m+1) to the first signal line Ld(m). As a result, the input of the pixel signal voltage Vsig2(k) to the second signal line Ld(m+1) ends at the time t5. However, as described above, since the capacity of the signal line Ld is sufficiently larger than the capacity of the signal storing capacitor Cs, the voltage of the second signal line Ld(m+1) is maintained at the pixel signal voltage Vsig2(k) even during the period after the time t5, more specifically during the period from t5 to t6.

The application of the on-voltage Von to the second scan line Ls2(k) continues even after the end (at the time t5) of selecting the second signal line Ld(m+1). Therefore, the on-state of the switching transistors Ts1 and Ts2, in other words, the input of the pixel signal voltage Vsig2(k) to the signal storing capacitor Cs2, and the application of the power supply voltage Vdd to the signal storing capacitor Cs2 continues even after the end (at the time t5) of selecting the second signal line Ld(m+1) to last longer than the signal writing period in which line Ld(m+1) to last longer than the signal writing period in which the second signal line Ld(m+1) is selected. As a result, the voltage of the signal storing capacitor Cs2 can sufficiently converge to "(Vdd−Vth2)−Vsig2(k)". The application of the on-voltage Von to the second scan line Ls2(k) ends at time t6. Accordingly, the period from t4 to t6 is the "signal converging period" for the second pixel circuit Pc2(k).

As shown in FIG. 10, at the time t6, the off-voltage Voff is applied to the second scan line Ls2(k) and the on-voltage Von is applied to the lightning scan line Le(k). As a result, the light emitting element D of the first pixel circuit Pc1(k) is connected to the power supply line Lv through the switching transistor Ts4 and the drive transistor Td, so that electric current is supplied to the light emitting element D. At the same time, the light emitting element D of the second pixel circuit Pc2(k) is connected to the power supply line Lv through the switching transistor Ts4 and the drive transistor Td, so that electric current is supplied to the light emitting element D. The supply of the electric current continues until the start (at the time t1) of the initialization period in the next frame period.

[First Modification of Display Device]

Figure 11:
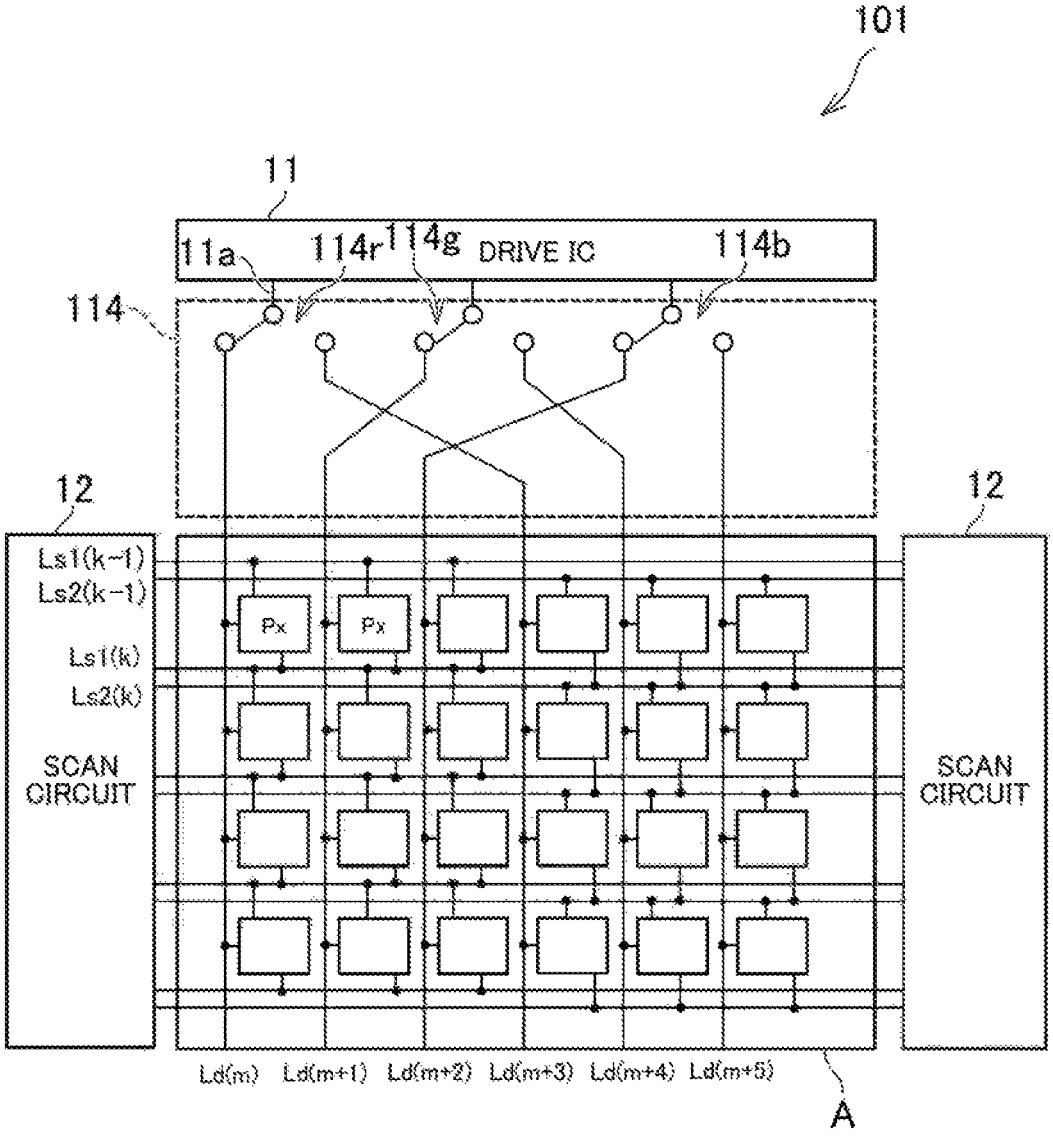
FIG. 11 shows a modified example of the display device.

The signal line selection circuit 14 described above selectively connects two adjacent signal lines Ld(m) and Ld(m+1) to a single output terminal 11a of the drive IC 11. However, the signal line selection circuit 14 may selectively connect signal lines Ld that are away from each other to a single output terminal 11a of the drive IC 11. FIG. 11 shows a display device 101 having a modification of the signal line selection circuit 14. The signal line selection circuit 114 shown in FIG. 11 includes switches 114r, 114g, and 114b. The switch 114r associates the signal line L(m) and the signal line L(m+3) with a single output terminal 11a of the drive IC 11 to selectively connect the two signal lines L(m)

and L(m+3) to the output terminal 11*a*. A pixel Px connected to the signal line L(m) and another pixel Px connected to the signal line L(m+3) emit light of the same color. Similarly, the switch 114*g* selectively connects the two signal lines L(m+1) and L(m+4) with a single output terminal 11*a*. The switch 114*b* selectively connects the two signal lines L(m+2) and L(m+5) with a single output terminal 11*a*. A pixel Px connected to the signal line L(m+1) and another pixel Px connected to the signal line L(m+4) emit light of the same color. Further, a pixel Px connected to the signal line L(m+2) and another pixel Px connected to the signal line L(m+5) emit light of the same color. The above described display device 101 enables the signal output characteristics (for example, gamma characteristics) of the drive IC 11 to be adjusted depending on the colors. In the Example of FIG. 11, the signal lines L(m), L(m+1), and L(m+2) are selected in the first half period of one horizontal scan period, and the signal lines L(m+3), L(m+4), and L(m+5) are selected in the second half period of the one horizontal scan period.

[Second Modification of Display Device]

Figure 12:
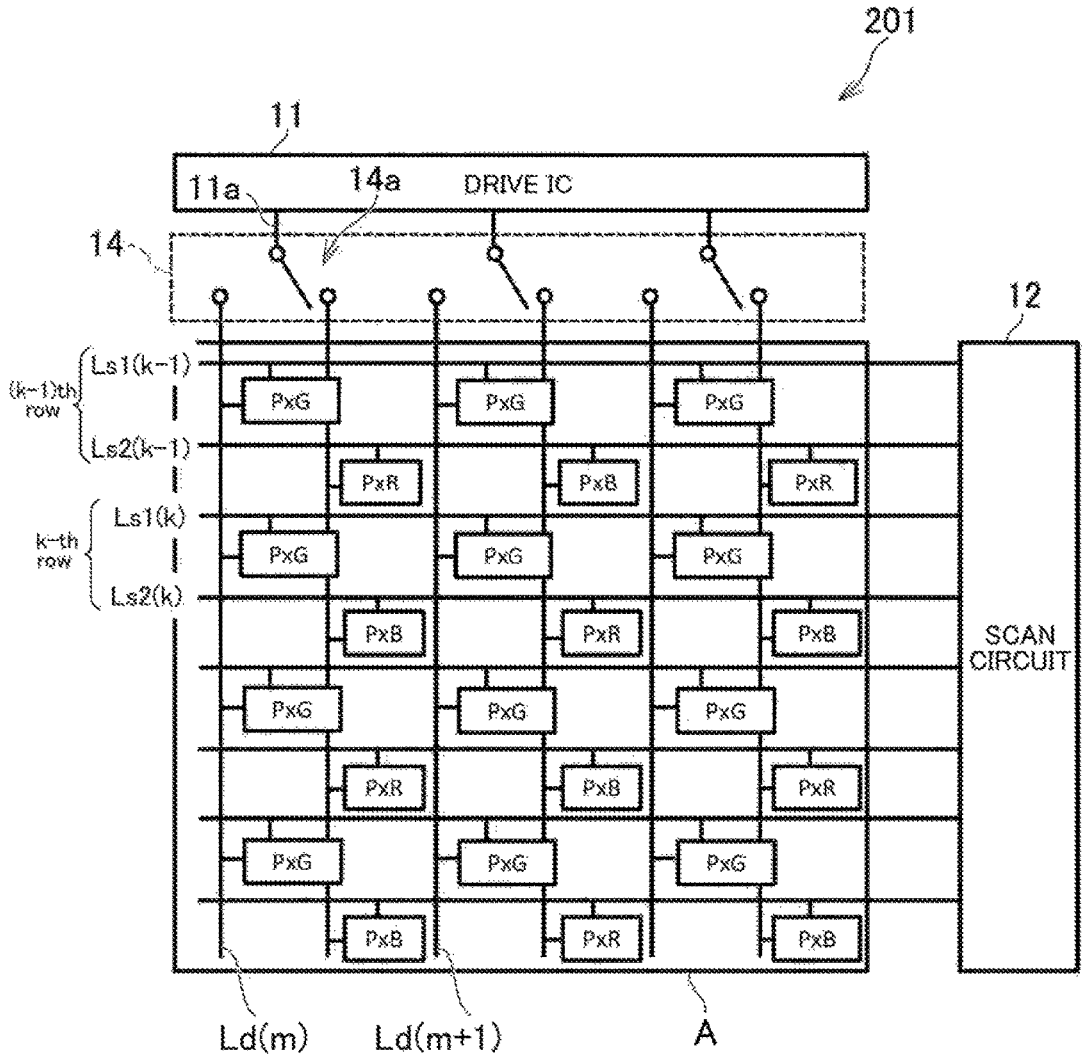
FIG. 12 shows still another modified example of the display device. This figure shows the outline of a display device having Pen Tile matrices.

Also, the present invention may be applied to a display device in which pixels Px are arranged in so-called Pen Tile matrices. FIG. 12 shows an outline of a display device 201 having Pen Tile matrices. Symbols PxG, PxR, PxB in FIG. 12 indicate green pixel, red pixel, and blue pixel, respectively. In the example of this figure, the green pixel PxG and the red pixel PxR constitute one pixel pair, and another green pixel PxG and the blue pixel PxB constitute one pixel pair. Then, the two kinds of pixel pairs are alternately arranged in the horizontal direction and the vertical direction. Two scan lines are provided for each pixel row. For example, a first scan line L1(*k*) and a second scan line L2(*k*) are provided in the k-th pixel row. In a partial period of one horizontal scan period, the signal line selection circuit 14 selects the signal line to which the pixel circuit of the green pixel PxG is connected and connects the selected line to the output terminal 11*a* of the drive IC 11. Then, in the other partial period of the one horizontal scan period, the signal line selection circuit 14 selects the signal line to which the pixel circuit of the red pixel PxR or the blue pixel PxB are connected and connects the selected line to the output terminal 11*a* of the drive IC 11.

[Third Modification of Display Device]

Figure 13:
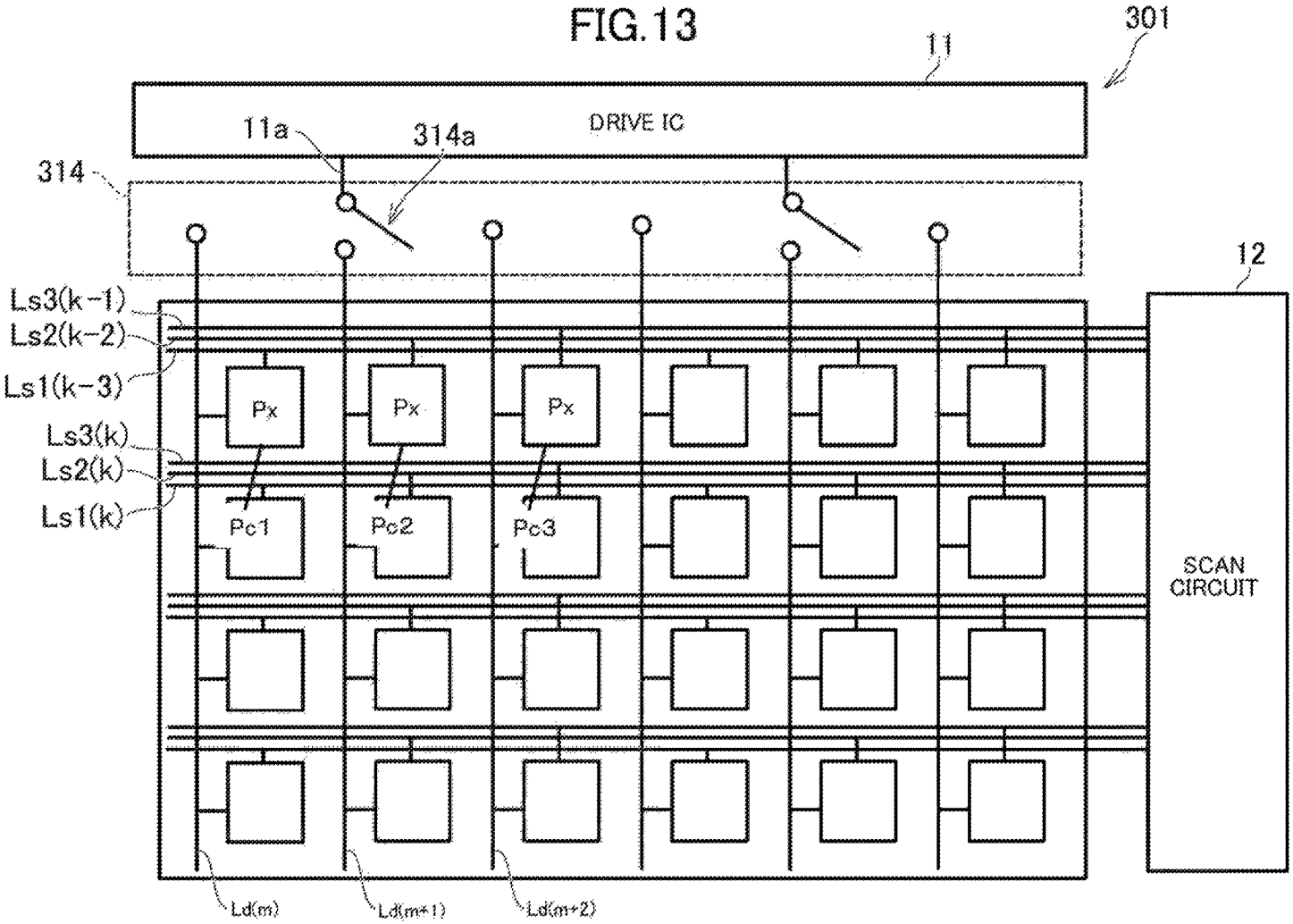
FIG. 13 shows still another modified example of the display lines with a single output terminal of the drive IC.

FIG. 13 shows still another modification of the display device 1. A signal line selection circuit 314 of the display device 301 shown in this figure associates three signal lines Ld with a single output terminal 11*a* of the drive IC 11. The signal line selection circuit 314 selectively connects the three signal lines Ld to the output terminal 11*a* in one horizontal scan period. In the example of FIG. 13, consecutively arranged three signal lines Ld, that is, a first signal line Ld(m), a second signal line Ld(m+1), and a third signal line Ld(m+2) are associated with a single output terminal 11*a*. Hereinafter, the pixel circuit Pc of the pixel Px connected to the first signal line Ld(m) will be referred to as a first pixel circuit Pc1. The pixel circuit Pc of the pixel Px connected to the second signal line Ld(m+1) will be referred to as a second pixel circuit Pc2. Further, the pixel circuit Pc of the pixel Px connected to the third signal line Ld(m+2) is referred to as a third pixel circuit Pc3.

Three scan lines Ls1, Ls2, and Ls3 are provided in each pixel row. The first pixel circuit Pc1 is connected to the first scan line Ls1, the second pixel circuit Pc2 is connected to the second scan line Ls2, the third pixel circuit Pc3 is connected to the third scan line Ls3. In detail, the gates of the switching transistors Ts1 and T2 (see FIG. 3, for example) of the first pixel circuit Pc1 are connected to the first scan line Ls1. The gates of the switching transistors Ts1 and Ts2 of the second pixel circuit Pc 2 are connected to the second scan line Ls 2. The gates of the switching transistors Ts1 and Ts2 of the third pixel circuit Pc3 are connected to the third scan line Ls3. The pixel circuits Pc in the example of FIG. 13 may employ those shown in FIG. 3, or may employ those shown in FIG. 7 or FIG. 8.

In a partial period of one horizontal scan period, the signal line selection circuit 34 connects the first signal line Ld(m) to the drive IC 11 and inputs a pixel signal voltage Vsig received from the drive IC 11 to the first signal line Ld(m). For example, the signal line selection circuit 314 connects the first signal line Ld(m) to the drive IC 11 in one third of one horizontal scan period. Likewise, the signal line selection circuit 314 connects the second signal line Ld(m+1) to the drive IC 11 during another one third period of the one horizontal scan period and inputs a pixel signal voltage Vsig to the second signal line Ld(m+1). Then, the signal line selection circuit 314 connects the third signal line Ld(m+2) to the drive IC 11 during still another one third period of the one horizontal scan period and inputs a pixel signal voltage Vsig to the third signal line Ld(m+2).

Figure 14:
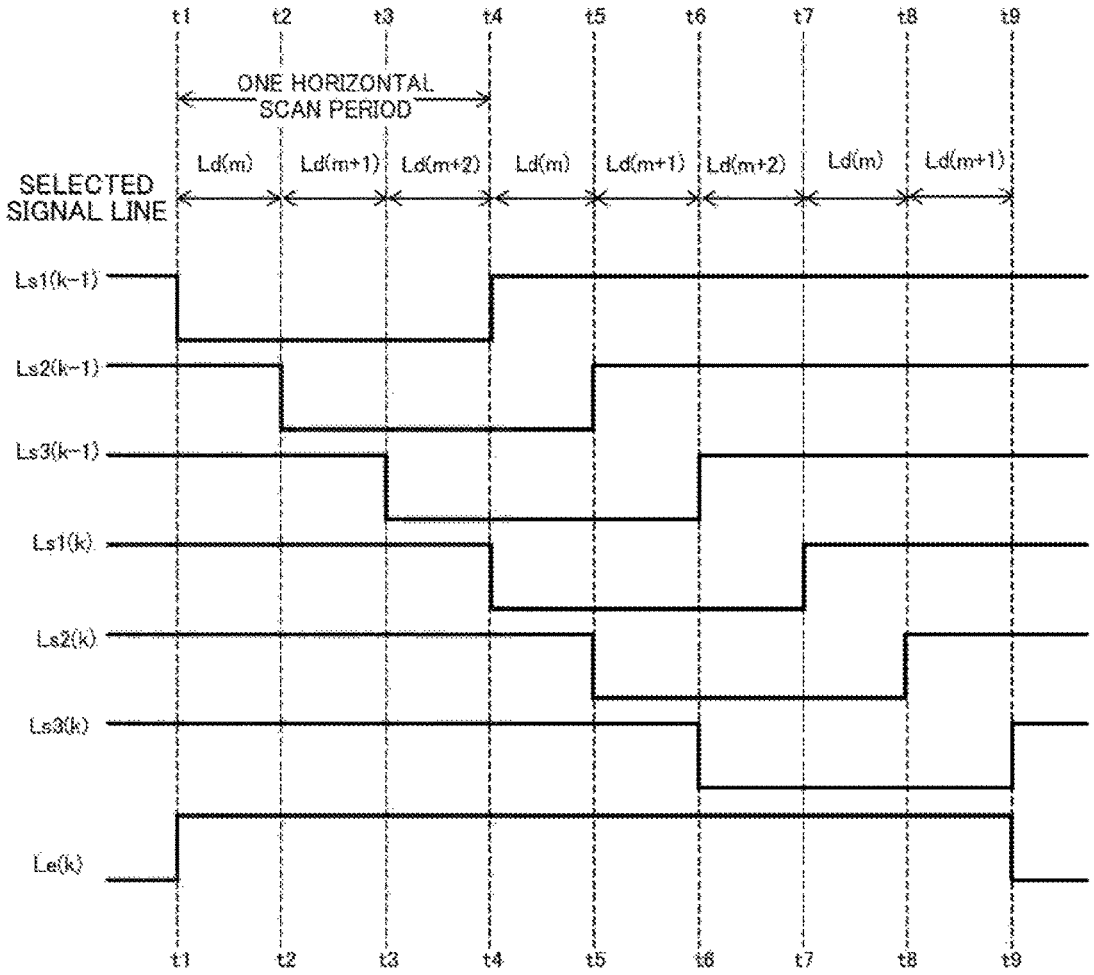
FIG. 14 is a timing chart for explaining a method of driving the display device exemplified by FIG. 13.

FIG. 14 is a timing chart for explaining the method of driving the display device exemplified in FIG. 13. This figure indicates signal line selected in the signal line selection circuit 314, voltage of the scan line Ls, and voltage of the lightning scan line Le.

As shown in FIG. 14, the off-voltage is applied to the lightning scan line Le(k) at time t1, so that the light emitting elements D of the first pixel circuit Pc1(*k*), the second pixel circuit Pc2(*k*), and the third pixel circuit Pc3(*k*) stop emitting light. Then, in the period from t1 to t4, the on-voltage is applied to the first scan line Ls1(*k*−1) of the immediately previous pixel row. As a result, similarly to the examples shown in FIG. 4A and FIG. 9A, the first pixel circuit Pc1(*k*) is initialized. In the period of t2 to t5, the on-voltage is applied to the second scan line Ls2(*k*−1) of the immediately previous pixel row, thereby initializing the second pixel circuit Pc2(*k*). Furthermore, during the period from t3 to t6, the on-voltage is applied to the third scan line Ls3(*k*−1) of the immediately previous pixel row, thereby initializing the third pixel circuit Pc3(*k*).

As shown in FIG. 14, when the first signal line Ld(m) is selected at time t4, the pixel signal voltage Vsig is input from the drive IC 11 to the first signal line Ld(m). At this time, the on-voltage is applied to the first scan line Ls1(*k*), so that the pixel signal voltage Vsig is input from the first signal line Ld(m) to the first pixel circuit Pc1(*k*). At time t5, the signal line selection circuit 314 stops selecting the first signal line Ld(m). Since the on-voltage is applied to the first scan line Ls1(*k*) even after the time t5, the input of the pixel signal voltage Vsig from the first signal line Ld(m) to the first pixel circuit Pc1(*k*) continues after the time t5. As a result, the voltage of the signal storing capacitor Cs (see FIG. 3 or FIG. 9) converges a voltage (for example, "(Vsig−Vth)−Vdd") that is shifted by the threshold voltage Vth of the drive transistor Td from a voltage corresponding to the pixel signal voltage Vsig. The on-voltage of the first scan line Ls1(*k*) continues until time t7. Therefore, in the period from t4 to t7, the pixel signal voltage Vsig is input from the first signal line Ld(m) to the first pixel circuit Pc(k).

At the time t5, the second signal line Ld(m+1) is selected instead of the first signal line Ld(m), and the pixel signal voltage Vsig for the second pixel circuit Pc2(*k*) is input from the drive IC 11 to the second signal line Ld(m+1). At this time, the on-voltage is applied to the second scan line Ls2(*k*), so that the pixel signal voltage Vsig is input from the second signal line Ld(m+1) to the second pixel circuit Pc2(*k*). At time t6, the signal line selection circuit 214 ends the selection of the second signal line Ld(m+1). However, since the on-voltage is applied to the second scan line Ls2(*k*) after the time t6, the input of the pixel signal voltage Vsig from the second signal line Ld(m+1) to the second pixel circuit Pc2(*k*) continues even after the time t6. The on-voltage of the second scan line Ls2(*k*) continues until time t8. Therefore, the pixel signal voltage Vsig is input from the second signal line Ld(m+1) to the second pixel circuit Pc2(*k*) during the period from t5 to t8.

At the time t6, the third signal line Ld(m+2) is selected and the pixel signal voltage Vsig for the third pixel circuit Pc3(*k*) is input from the drive IC 11 to the third signal line Ld(m+2). At this time, the on-voltage is applied to the third scan line Ls3(*k*), so that the pixel signal voltage Vsig is input from the third signal line Ld(m+2) to the third pixel circuit Pc3(*k*). At time t7, the signal line selection circuit 214 ends the selection of the third signal line Ld(m+2). However, since the on-voltage is applied to the third scan line Ls3(*k*) after the time t7, the input of the pixel signal voltage Vsig from the third signal line Ld(m+2) to the third pixel circuit Pc3(*k*) continues even after the time t7. The on-voltage of the third scan line Ls3(*k*) continues until time t9. Therefore, during the period form t6 to t9, the pixel signal voltage Vsig is input from the third signal line Ld(m+2) to the third pixel circuit Pc3(*k*).

At the time t9, the voltage of the third scan line Ls3(*k*) changes to the off-voltage Voff, and the on-voltage is applied to the lightning scan line Le(k). As a result, electric currents are supplied to the light emitting elements D of the first pixel circuit Pc1 (*k*), the second pixel circuit Pc2(*k*), and the third pixel circuit Pc3(*k*). The supply to light emitting element D continues until the time t1 of the next frame period.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the claims.

What is claimed is:

1. A driving method of a display device, the display device comprising:

a plurality of pixels including a first pixel and a second pixel;

a first pixel circuit provided to the first pixel, and including a light emitting element and a first drive transistor connected to the light emitting element;

a second pixel circuit provided to the second pixel, and including a light emitting element and a second drive transistor connected to the light emitting element; and a plurality of signal lines including a first signal line connected to the first pixel circuit and a second signal line connected to the second pixel circuit, the driving method comprising steps of:

inputting a first pixel signal into the first signal line in a first signal writing period that is a partial period in one horizontal scan period to thereby store the first pixel signal in the first signal line;

inputting the first pixel signal to the first pixel circuit from the first signal line throughout a first signal converging period that includes at least a portion of the first signal writing period and is longer than the first signal writing period;

inputting a second pixel signal into the second signal line in a second signal writing period that is another partial period in the one horizontal scan period to thereby store the second pixel signal in the second signal line;

inputting the second pixel signal to the second pixel circuit from the second signal line throughout a second signal converging period that includes at least a portion of the second signal writing period and is longer than the second signal writing period; and turning the first drive transistor and the second drive transistor to an on-state after the first signal converging period and the second signal converging period to thereby supply electric current to the light emitting elements of the first pixel circuit and the second pixel circuit, wherein the one horizontal scan period has n signal writing periods defined therein, the n signal writing periods including the first signal writing period and the second signal writing period and not overlapping with each other, and each of the first signal converging period and the second signal converging period has n times the length of the signal writing period or is shorter than n times the length of the signal writing period.

2. The driving method according to claim 1, wherein the display device further comprises a drive integrated circuit that includes an output terminal connectable to the first signal line and the second signal line, and the driving method further comprises steps of connecting the output terminal and the first signal line in the first signal writing period, and connecting the output terminal and the second signal line in the second signal writing period.

3. The driving method according to claim 1, wherein the first signal converging period has a start synchronized with a start of the first signal writing period, and the second signal converging period has a start synchronized with a start of the second signal writing period.

4. The driving method according to claim 1, wherein the first signal converging period includes a partial period overlapping with the second signal converging period.

5. The driving method according to claim 1, wherein a voltage of a signal storing capacitor connected to a gate of the first drive transistor of the first pixel circuit converges in the first signal converging period to a voltage shifted by a threshold voltage of the drive transistor of the first pixel circuit from a voltage corresponding to the first pixel signal, and a voltage of a signal storing capacitor connected to a gate of the second drive transistor of the second pixel circuit converges in the second signal converging period to a voltage shifted by a threshold voltage of the drive transistor of the second pixel circuit from a voltage corresponding to the second pixel signal.

6. The driving method according to claim 1, wherein the plurality of pixels further include a third pixel, the third pixel includes a light emitting element and a third pixel circuit including a third drive transistor connected to the light emitting element, the driving method comprises steps of inputting a third pixel signal into a third signal line in a third signal writing period that is a partial period in the one horizontal scan period to thereby store the third pixel signal in the third signal line, and inputting the third pixel signal to the third pixel circuit from the third signal line throughout a third signal converging period that includes at least a portion of the third signal writing period and is longer than the third signal writing period.

7. A driving method of a display device, the display device comprising:

a plurality of pixels including a first pixel and a second pixel;

a first pixel circuit provided to the first pixel, and including a light emitting element and a first drive transistor connected to the light emitting element;

a second pixel circuit provided to the second pixel, and including a light emitting element and a second drive transistor connected to the light emitting element; and a plurality of signal lines including a first signal line connected to the first pixel circuit and a second signal line connected to the second pixel circuit, the driving method comprising steps of:

inputting a first pixel signal into the first signal line in a first signal writing period that is a partial period in one horizontal scan period to thereby store the first pixel signal in the first signal line;

inputting the first pixel signal to the first pixel circuit from the first signal line throughout a first signal converging period that includes at least a portion of the first signal writing period and is longer than the first signal writing period;

inputting a second pixel signal into the second signal line in a second signal writing period that is another partial period in the one horizontal scan period to thereby store the second pixel signal in the second signal line;

inputting the second pixel signal to the second pixel circuit from the second signal line throughout a second signal converging period that includes at least a portion of the second signal writing period and is longer than the second signal writing period; and turning the first drive transistor and the second drive transistor to an on-state after the first signal converging period and the second signal converging period to thereby supply electric current to the light emitting elements of the first pixel circuit and the second pixel circuit, wherein the first signal converging period includes a partial period overlapping with the second signal converging period.

8. The driving method according to claim 7, wherein the display device further comprises a driver circuit that includes an output terminal connectable to the first signal line and the second signal line, and the driving method further comprises steps of connecting the output terminal and the first signal line in the first signal writing period, and connecting the output terminal and the second signal line in the second signal writing period.

9. The driving method according to claim 7, wherein the first signal converging period has a start synchronized with a start of the first signal writing period, and the second signal converging period has a start synchronized with a start of the second signal writing period.

10. The driving method according to claim 7, wherein a voltage of a signal storing capacitor connected to a gate of the first drive transistor of the first pixel circuit converges in the first signal converging period to a voltage shifted by a threshold voltage of the drive transistor of the first pixel circuit from a voltage corresponding to the first pixel signal, and a voltage of a signal storing capacitor connected to a gate of the second drive transistor of the second pixel circuit converges in the second signal converging period to a voltage shifted by a threshold voltage of the drive transistor of the second pixel circuit from a voltage corresponding to the second pixel signal.

11. The driving method according to claim 7, wherein the plurality of pixels further include a third pixel, the third pixel includes a light emitting element and a third pixel circuit including a third drive transistor connected to the light emitting element, the drive method comprises the steps of inputting a third pixel signal into a third signal line in a third signal writing period that is a partial period in the one horizontal scan period to thereby store the third pixel signal in the third signal line, and inputting the third pixel signal to the third pixel circuit from the third signal line throughout a third signal converging period that includes at least a portion of the third signal writing period and is longer than the third signal writing period.

* * * * *